US011752505B2

(12) United States Patent
Schie

(10) Patent No.: US 11,752,505 B2
(45) Date of Patent: Sep. 12, 2023

(54) WOOD CHIPPER WITH MORE EFFECTIVE IN-FEED ROLLERS

(71) Applicant: Kurt M. Schie, Akron, NY (US)

(72) Inventor: Kurt M. Schie, Akron, NY (US)

( * ) Notice: Subject to any disclaimer, the term of this patent is extended or adjusted under 35 U.S.C. 154(b) by 412 days.

(21) Appl. No.: 16/715,210

(22) Filed: Dec. 16, 2019

(65) Prior Publication Data

US 2020/0114367 A1 Apr. 16, 2020

Related U.S. Application Data

(62) Division of application No. 14/157,482, filed on Jan. 16, 2014, now Pat. No. 10,507,469.

(60) Provisional application No. 61/754,373, filed on Jan. 18, 2013.

(51) Int. Cl.

| | |
|---|---|
| ***B02C 18/22*** | (2006.01) |
| ***B27L 11/00*** | (2006.01) |
| ***B02C 18/16*** | (2006.01) |

(52) U.S. Cl.

CPC ..... *B02C 18/2283* (2013.01); *B27L 11/002* (2013.01); *B02C 2018/168* (2013.01)

(58) Field of Classification Search

CPC ..... B27L 11/00; B27L 11/005; B27L 11/02; B27L 11/04; B27L 11/06; B27L 11/08; B02C 18/06; B02C 18/22; B02C 18/2225; B02C 18/2283

USPC ..... 241/92

See application file for complete search history.

(56) References Cited

U.S. PATENT DOCUMENTS

| | | | | |
|---|---|---|---|---|
| 3,913,642 | A * | 10/1975 | Porter | B27M 1/003 144/369 |
| 4,390,132 | A * | 6/1983 | Hutson | B27L 11/02 241/101.76 |
| 4,524,780 | A * | 6/1985 | Warkentin | A01F 11/00 56/14.4 |
| 5,320,153 | A * | 6/1994 | Knerr | B27B 1/007 144/248.6 |
| 6,357,684 | B1 * | 3/2002 | Morey | A01G 3/002 241/301 |
| 6,435,432 | B1 * | 8/2002 | Doskocil | A01G 3/002 241/285.2 |
| 6,729,567 | B1 * | 5/2004 | Morey | B02C 18/2283 241/92 |
| 10,507,469 | B2 * | 12/2019 | Schie | B02C 18/2283 |

(Continued)

FOREIGN PATENT DOCUMENTS

| | | | | |
|---|---|---|---|---|
| DE | 19824105 | A1 * | 12/1999 | B02C 18/2283 |
| DE | 19850727 | A1 * | 5/2000 | B02C 18/145 |

(Continued)

*Primary Examiner* — Shelley M Self
*Assistant Examiner* — Jared O Brown
(74) *Attorney, Agent, or Firm* — James C. Simmons

(57) ABSTRACT

A wood chipper comprising a chamber in which wood is chipped, and a pair of rollers for feeding of the wood into the chamber. One of the rollers is a smooth roller and may or may not be an idle roller, and an other of the rollers is driven and has cutting elements thereon. One or more pressurized gas springs are attached to the rollers to apply a predetermined pressure to the rollers to cause the cutting elements to bite into the wood fed between the rollers. The cutting elements are blades each of which is un-notched in a direction radially of the other roller and each of which extends over substantially the entire length of the other roller.

19 Claims, 20 Drawing Sheets

(56) References Cited

U.S. PATENT DOCUMENTS

| | | | | |
|---|---|---|---|---|
| 2003/0111566 | A1* | 6/2003 | Seaman | B02C 18/2283 241/34 |
| 2008/0078851 | A1* | 4/2008 | Stelter | B27L 11/002 241/34 |
| 2008/0272215 | A1* | 11/2008 | Bouwers | B27L 11/002 241/301 |
| 2010/0001107 | A1* | 1/2010 | Kallenbach | B02C 18/2283 241/34 |
| 2010/0126628 | A1* | 5/2010 | Leonard | B02C 18/2225 144/246.1 |
| 2010/0294869 | A1* | 11/2010 | Bradley | A01G 3/002 241/186.4 |
| 2011/0006142 | A1* | 1/2011 | Galloway | B02C 18/145 241/28 |
| 2011/0083413 | A1* | 4/2011 | Jackson | A01D 34/82 56/14.7 |
| 2014/0209721 | A1* | 7/2014 | Kennedy | B02C 25/00 241/37.5 |

FOREIGN PATENT DOCUMENTS

| | | | | |
|---|---|---|---|---|
| EP | 2650050 | A1 * | 10/2013 | B02C 18/143 |
| FR | 651039 | A * | 2/1929 | B27L 11/02 |
| KR | 200375515 | Y1 * | 3/2005 | B02C 4/10 |
| SE | 450938 | B * | 8/1987 | B27L 11/02 |

* cited by examiner

WOOD CHIPPER WITH MORE EFFECTIVE IN-FEED ROLLERS

This is a divisional of U.S. patent application Ser. No. 14/157,482, filed Jan. 16, 2014, and the priority of U.S. provisional application 61/754,373, filed Jan. 18, 2013, is hereby claimed, and these applications are incorporated herein by reference.

The present invention relates generally to wood chippers. More particularly, the present invention relates to wood chippers of a type wherein wood is fed into a chamber or housing which contains a flywheel or spinning disc to which are attached radially-extending cutting blades which chip the wood, and the chips are then discharged. Such a type of wood chipper is disclosed in U.S. Pat. No. 7,878,434, which is hereby incorporated herein by reference. Such a spinning disk and blades for chipping wood are illustrated in FIG. 5 of the aforesaid patent, the spinning disc contained within housing, illustrated at 18 in the drawings of the aforesaid patent.

When such a wood chipper utilizes in-feed rollers, it is an object of the present invention to adjust the gap between the rollers so as to more efficiently and easily handle different sizes of wood being passed therethrough to be chipped.

Typical prior art upper and lower rollers, illustrated at 12 and 14 respectively in FIG. 6 of the present application, for wood chippers are identical, each having circumferentially spaced cutting portions, illustrated at 16, wherein each cutting portion 16 is formed of a plurality of teeth 18 spaced lengthwise thereof. The teeth 18 undesirably grab and trap vines and leaves impacted thereon causing jamming, resulting in substantial work to clean the material from them.

It is accordingly another object of the present invention to prevent or substantially reduce such trapping of vines and leaves and the like so as to alleviate the difficulty of cleaning such material from the in-feed rollers.

When such a wood chipper utilizes power take-off from a tractor to power the flywheel, illustrated at 24 in FIGS. 8 and 9 of the present application, and/or the hydraulic system, it is important that the splined flywheel drive pulley connector, illustrated at 22 in FIG. 3 as well as FIG. 1 of the present application, be aligned (at least to about 15 degrees, but preferably in as close alignment as possible) with the mating splined connector of the tractor power take-off means, to eliminate or substantially reduce harmful oscillation vibrations. However, the height of the tractor power take-off may vary anywhere from 18 inches to 3 feet from the ground, and the amount of deflection should not be more than about 15 degrees, but the greater the deflection, the more that harmful oscillation vibrations may be a problem.

It is accordingly another object of the present invention to more closely align (i.e., with minimal deflection) the splined connections of the flywheel drive pulley connector and power take-off means so as to prevent or substantially reduce such harmful oscillation vibrations, to thereby better allow the use of the wood chipper with tractors of different sizes.

It is a further object of the present invention to enable adjustments so that the wood chipper can accept a large variety of wood, i.e., both soft and hard.

It is a yet another object of the present invention to enable easy hitching of the wood chipper to a tractor having 3-point hitch brackets.

As discussed in the last full paragraph in col. 4 of the aforesaid patent, vent holes to the spinning disk housing are provided to allow more air into the system so that the wood chipper is able to discharge more air out of the discharge chute and improve the air flow and to help the machine avoid clogging. The pattern of vent holes illustrated in FIG. 7 of the aforesaid patent is six vertically spaced rows of four vent holes each (total of 24 vent holes) located above the spinning disk shaft and illustrated to be apparently offset therefrom. The resulting suction intake of air into the spinning disk housing creates a vortex to eject chips. It is thus considered desirable to increase the amount of air sucked in to the spinning disk housing.

A typical vent hole pattern is arranged to have 3 rows of 3 vent holes (total of 9 vent holes) spaced center to center both vertically and horizontally about 35 mm and each having a diameter of about 12 mm and located above the spinning disk shaft. Such an arrangement provides only minimal air flow.

It is accordingly a further object of the present invention to arrange the vent holes to increase and efficiently utilize the amount of air sucked in to the spinning disk housing.

Conventional hydraulic fluid powered transmission systems, illustrated schematically generally at 1000 in FIG. 16, are commonly used for wood chipper in-feed roller drives. The components thereof are not only shown in FIG. 16 but in other FIGS. of the drawings as well. Power supplied by the chipper's main power source such as a tractor or an engine that otherwise drives the flywheel also typically provides a source to drive the hydraulic pump 80 to supply hydraulic pressure to drive the in-feed roller 70 (and also the in-feed roller 72, if driven). This is typically from a belt driven from the main shaft to provide a power source to the hydraulic pump 80. These typical hydraulic systems 1000 are found on many wood chippers available worldwide and are a common application for driving one or both of the in-feed rollers 70 and 72.

Referring to FIG. 16, the hydraulic fluid pump 80 receives suction from hydraulic fluid reservoir 78 via filter 1002 and discharges to an hydraulic control valve 85 via an hydraulic diverter flow control valve 82. This valve 82 may be either fixed or adjustable and provides overflow (of fluid volume not used) back to the reservoir 78. The flow control valve 85 may be in neutral wherein the fluid flow is back to the reservoir or in forward or reverse operation of hydraulic motor 74 for operation in forward or reverse of the roller 70, all as illustrated by arrows showing fluid flow.

Hydraulic systems provide a reliable transfer of energy to be easily routed to areas that are difficult to address with most mechanical transmission methods. This is due to the flexibility of the high pressure hydraulic hose that provide the power transfer to a corresponding motor 74 (and perhaps also 76).

Hydraulic pump systems require a sizing or proportional balance to operate efficiently. Moreover, even a well-balanced system will produce a significant loss of energy though inefficiency. This loss of energy is caused by heat built up in the fluid itself moving from the pump 80, valves, and motors and therefore requires a relatively large fluid return reservoir 78 to allow the returned heated fluid to cool and to rise to a higher viscosity. It is important for hydraulic fluid viscosity to be maintained to an operational level in order to provide the proper efficient transfer of energy from the pump 80 to the motor (and perhaps also 76). If the fluid is heated too high, the viscosity lowers causing the fluid to slip by the impellers within the pump 80 and motor 74 (and perhaps also 76), causing loss of energy transfer. The action of the fluid itself slipping through small orifices and gaps under extreme pump pressure actually causes more friction, and friction causes more heat, and more heat decreases fluid viscosity. This is why it is important in a hydraulic system to properly size all components with care, not to oversize the pump capacity and or undersize a motor capacity for this reason. There are numerous problems that exist in pressure hydraulics besides heat generation. Cavitation (which may be described as the generation of vapor created by rapid changes of pressure) is one such other problem that can create excessive wear and damage to hydraulic components.

Typical hydraulic systems are static in terms of flow and pressure and transfer energy on a constant rate, with the exception of a few variables, one being the speed and torque of the driving power source and another being the addition of flow controlling devices and valves. With a wood chipper, it is unadvisable to alter the output power or rpm of the main drive power source above or below what is required for safe and efficient chipping operations. If a hydraulic pump was slowed to decrease its flow, pressure also falls off, substantially reducing torque required to adequately drive the motor 74 (and perhaps also 76) which is required to move a large log forcibly into the flywheel to be chipped. Therefore, a common method used to alter the hydraulic systems in-feed drive speed is by controlling the pumps' fixed output flow by diversion. The introduction of a flow diverter or control device in the pressurized hydraulic system requires the diverted pressure to flow back into the reservoir and therefore slow the rpms at the in-feed motor 74 (and perhaps also 76). This must be done effectively while maintaining a high pressure to the drive motor (and perhaps also 76). This requires a proper routing and restriction (valve) prior to the fluid entering the return line. Although simple in concept, it is important to note that this valve requires restrictions for both the returning fluid and the outlet towards the motor 74 (and perhaps also 76). The transfer of fluid is regulated and adjusted through these two restrictions in order to operate, and both of these restrictions produce additional heat in the fluid. Therefore, it is advisable and common that a hydraulic system be designed to and recommended to "free flow" within its maximum unrestricted output in order to maintain a higher level of efficiency while minimizing generation of heat as a result of friction upon the fluid. Therefore, if an operator needs a faster in-feed speed than was designed in the system, it would be impossible to achieve, and, conversely, if the system was designed to provide a higher flow than was normally used, excessive heat and loss of efficiency would result in an attempt to maintain the slower than designed speed. Thus, any valve or restriction device used to provide adjustability that lessens flow to less than 100% invariably will create more heat than if running unrestricted. Also, to control the forward and reverse or neutral motion of the in-feed roller 70 (and perhaps also 76), the hydraulic system requires a spool valve. This control device directs the fluid flow direction, and its position must be placed within the output stream.

Although the use of conventional hydraulic systems for powering in-feed rollers of wood chippers is straight forward and relatively common, as described above, they have numerous drawbacks and shortcomings. Conventional hydraulic systems for powering in-feed rollers of wood chippers are designed to feed materials at an optimal speed, usually fixed and with minimal ability for speed adjustment. This optimal speed usually is a speed that can readily feed the majority of average sized materials. In essence, this optimal speed is selected to be slow enough to accommodate the maximum expected branches without stalling the drive engine or stressing the machinery beyond its capacity. The user who is chipping smaller sized branches must accordingly wait for the slower in-feed rollers before inserting additional materials, even though the capacity of the chipper can easily accommodate smaller materials at a much higher speed. Since conventional chippers have a fixed in-feed rpm or one minimally or difficult to adjust, this prevents the operator from selecting a suitable speed on demand to match the chipper's output with various sized materials to be chipped.

It is accordingly a further object of the present invention to provide the ability to control the speed of the in-feed rollers quickly. More particularly, it is an object of the present invention to provide the ability to significantly increase chipping capacity by providing easy adjustment of the in-feed roller speed to thereby create a higher output of wood chipping in less time.

It is another object of the present invention to reduce or eliminate the other above shortcomings with hydraulic systems for in-feed roller drives and to provide an efficient in-feed roller drive system, without the above heat build-up problem, as is typical with conventional hydraulic systems.

A conventional in-feed roller tension device is a set of extension springs, illustrated at 300 in FIG. 2. Although simple, they have several drawbacks. Extension springs 300 are exposed to the weather and may accordingly corrode and weaken over time. Springs 300 also undesirably create significantly more tension the further they are extended. This causes the in-feed roller to be under a higher amount of tension the higher the roller rides, such as for a thick branch, greater tension is exerted upon the fed wood material. Conversely, the smaller the wood diameter, the less tension is exerted. This weakness could possibly cause the feed roller to slip against the wood, slowing the chipping action.

It is accordingly yet another object of the present invention to provide a more even force acting on the in-feed rollers.

It is a further object of the present invention to provide such a force means which provides a controlled rate of travel and therefore acts as a shock absorber and thus not allow the in-feed roller mechanism to slam forcibly downward once the material passes under.

It is another object of the present invention to protect the force means against corrosive elements to therefore increase its usable life.

Conventional wood chipper flywheel knives, illustrated at 120 in FIG. 9, are designed to provide constant cutting action of wood materials against a bed blade similarly to how a paper cutter's top blade scissors against a flat anvil or bed plate to cut the paper. The two opposing knives 120 are diametrically opposed to each other. This design has a set of knives that typically span the entire area of the chippers hopper area, i.e., the length of each knife is equal to substantially the radius of the flywheel. The chips created are directed through slots 138 in the flywheel and travel to the opposite side to be exhausted by centrifugal force by the revolving flywheel assembly action. Some conventional chippers incorporate 3 or 4 or perhaps more such knives which are equally spaced apart circumferentially to provide balance. It is considered desirable to match the speed of the cutting action to the number of blades used. For instance, to provide the same chips per minute for a 2-knife flywheel as for a 4-knife flywheel, it is necessary to revolve the 2-knife flywheel at twice the revolutions as the revolutions of the 4-knife flywheel. Doubling the number of knives would thus normally require a slower rpm. However, some tractors and power sources are smaller and would benefit by the increased inertia of a faster spinning flywheel.

It is accordingly a further object of the present invention to provide a faster spinning flywheel to obtain increased inertia.

It is another object of the present invention to provide, for the same number of chips per minute as provided by a flywheel such as that of FIGS. 8 and 9 having knifes lengths equal substantially to the flywheel radius, increased efficiency.

The above and other objects, features, and advantages of the present invention will be apparent in the following detailed description of the preferred embodiments thereof when read in conjunction with the appended drawings in which the same reference numerals depict the same or similar parts throughout the several views.

DETAILED DESCRIPTION OF THE PREFERRED EMBODIMENT(S)

Figure 1:
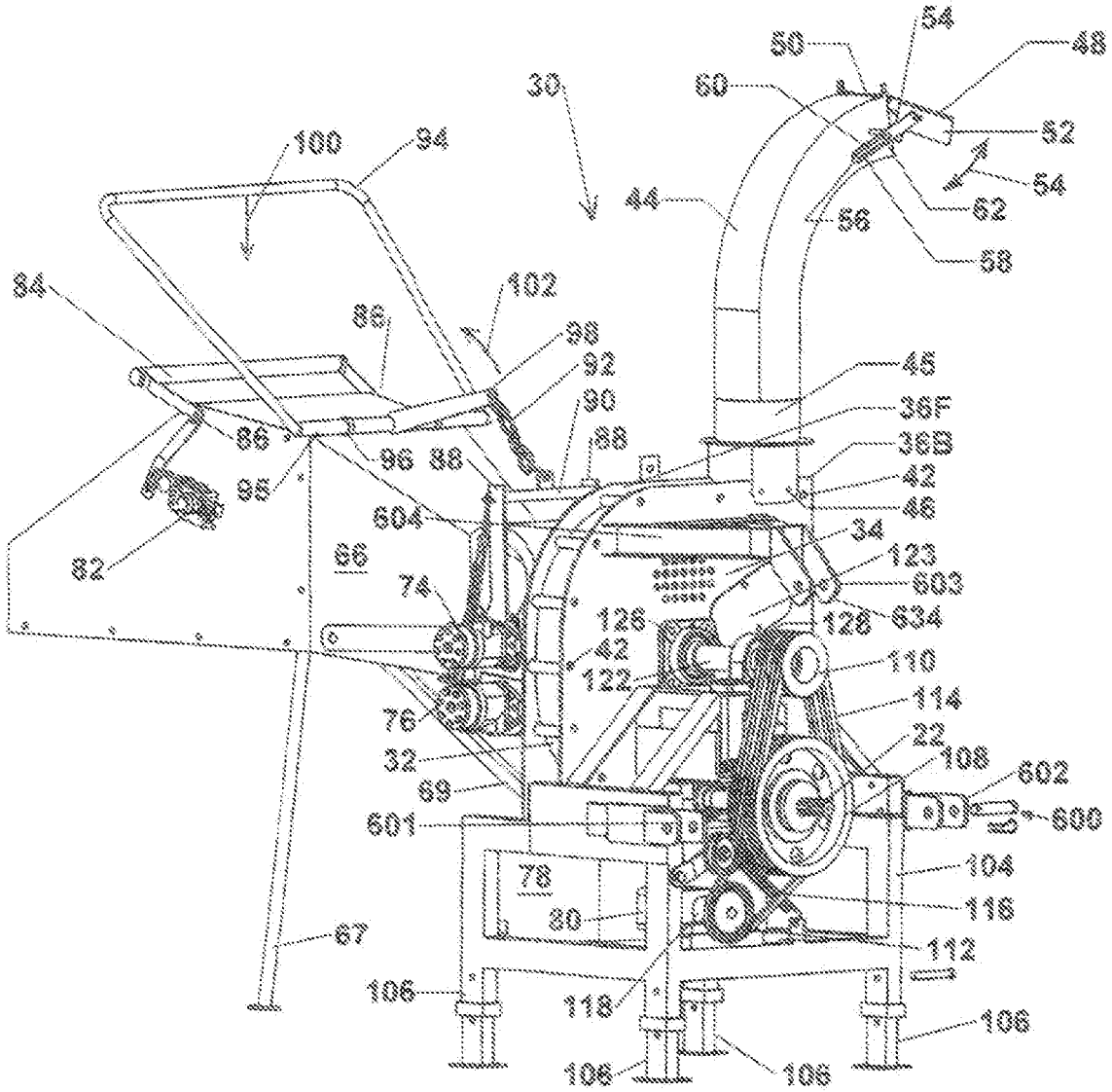
FIG. 1 is a perspective view of a wood chipper which embodies the present invention.

Referring to the drawings, there is shown generally at 30 a self-feeding wood chipper which is built to be robust and compact and quick hitch compatible yet to be able to withstand commercial use. Unless otherwise specified herein or otherwise apparent, components of the wood chipper 30 are composed of steel or other suitable metal, with desirably a rust resistant powder coat finish as appropriate. A powder coat is a "baked-on" finish, which is considered to be superior to paint. Its weight may, for example, be 990 pounds, provided by more steel thereby to provide more strength and stability.

The wood chipper 30 includes a cutting or wood chipping chamber 32 defined by a pair of parallel plates 34, i.e., front or face plate 34F and back plate 34B. These plates 34 are connected at their perimetric edge portions 36 by a partially arcuate plate 38 which is welded or otherwise suitable attached thereto, and a plurality of spaced strengthening rods 40 are suitably attached, such as by a suitable fastening means illustrated at 42, to the edge portions 36.

Chips formed of the wood in the cutting chamber 32 are discharged there from into a suitably formed discharge chute 44 which is suitably attached to the pair of plates 34 such as by fasteners illustrated at 46. The chute 44 is formed and attached to extend upwardly and then curved to direct the chips generally horizontally as they leave the outlet. The chute 44 has a conventional swivel mechanism, illustrated at 45, for rotating the chute 44 so that the discharge may be in any desirable direction. This allows one to direct chips into the back of a truck or trailer without having to move the entire wood chipper 30 and is also considered convenient for storage of the wood chipper 30.

The outlet of the discharge chute 44 has suitably hingedly attached thereto, as by hinge 50, a chip deflector 48 which includes a pair of parallel leaves 52 whose upper edges are joined by a central leaf 54. The chip deflector 48 is adjustable by a suitable adjustment mechanism illustrated at 56 to deflect the chips more or less downwardly so that the chips can "really fly" or be directed more directly at the ground as desired. The adjustment mechanism 56 is shown to include a pair of elongate members 58 (one shown) having ends suitably attached to the leaves 52 respectively and having the other ends with slots illustrated at 60, and fasteners illustrated at 62 are adjustably received in the slots and attached to respective walls of the chute 44 to thereby adjust the angle, as illustrated at 64, at which the chips are discharged from the chute 44.

The discharge chute 44 constitutes a means for discharging chipped wood from the chamber 32 or other wood-chipping means. However, other such means for discharging chipped wood are envisioned, such as the means for discharging chipped wood constituting the discharge chute shown in the aforesaid U.S. Pat. No. 7,878,434, and such other chipped wood discharging means are meant to come within the scope of the present invention as defined by the appended claims.

Figure 2:
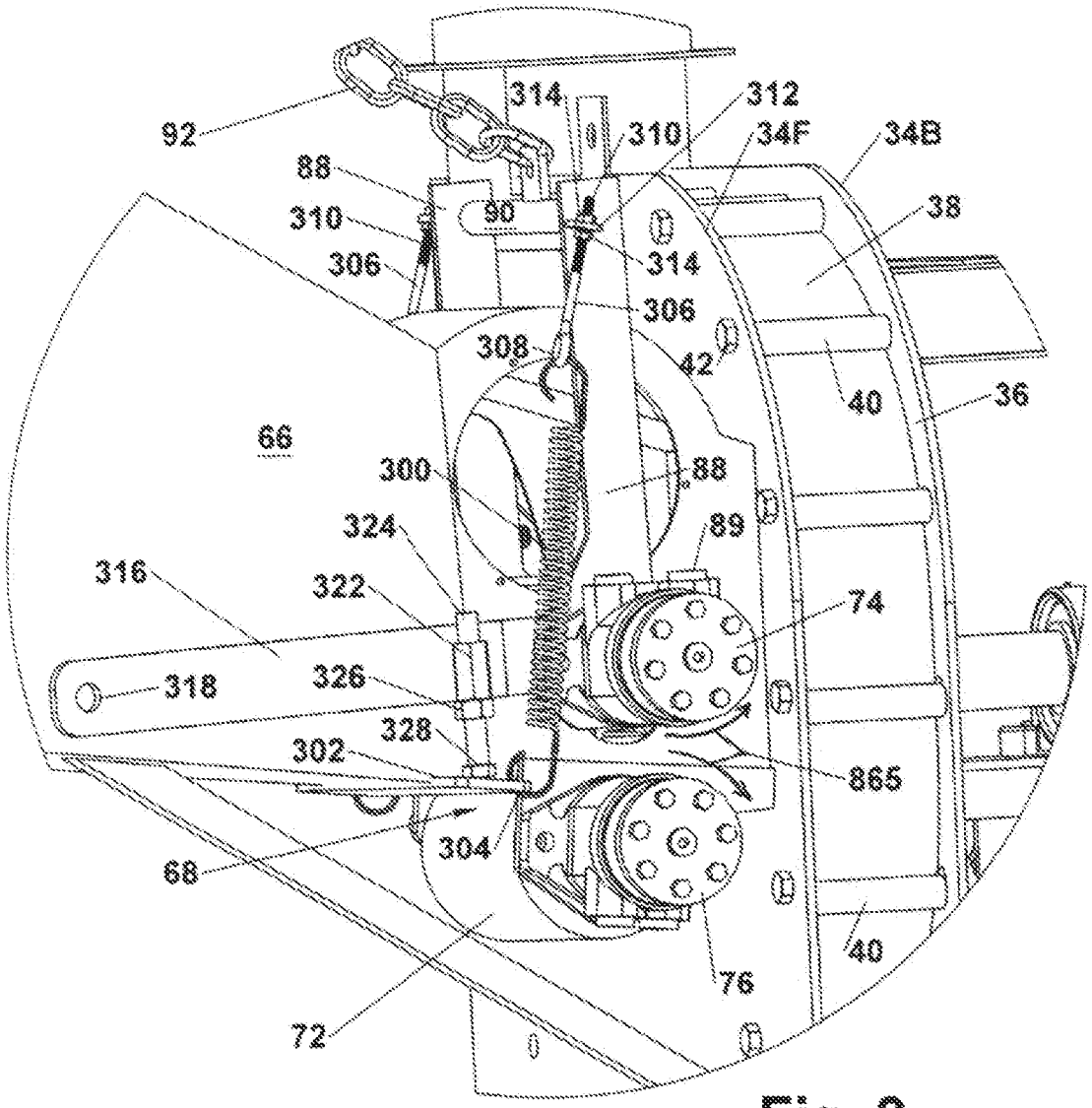
FIG. 2 is an enlarged perspective view of a portion of the wood chipper, illustrating a flywheel housing and the drive mechanism for upper and lower in-feed rollers thereof.

Wood to be chipped is fed into the wood chipper 30 by means of a suitably formed in-feed bin or hopper 66, having supporting stand 67 and brace 69, from which the wood to be chipped is suitably routed through an opening, as illustrated in FIG. 2 at 68, to in-feed rollers 70 and 72 (FIG. 7, discussed hereinafter) and thereafter to the cutting chamber 32. The in-feed opening 68 is desirably substantially square in shape, for example, it may be 8 inches by 8 inches (instead of the typical 8 inches wide by 4½ inches high for 8 inch chippers, i.e., chippers having 8 inch wide in-feed openings) in order to more easily accept crooked branches and the like. Suitably received in the opening 68 are the pair of upper and lower rollers 70 and 72 (FIG. 7, the lower roller 72 also seen in FIG. 2) which are provided to grab and pull wood material into the chipper head, i.e., the cutting chamber 32. A clear vinyl baffle (sheet) is desirably provided at the entrance to the opening 68 to protect the user from chip blow-back while allowing the user to see what is going on in the hopper. Illustrated at 74 and 76 are hydraulic drive motors for the rollers 70 and 72 respectively. The means of operative attachment of the drive motors 74 and 76 to the rollers 70 and 72 respectively for rotation thereof are within the knowledge and skill of one of ordinary skill in the art to which the present invention pertains and will therefore not be described in further detail herein. The rollers 70 and 72 are provided to deform the wood fed there through (which may be limbs and various forms of wood) into a reduced and otherwise suitable form for its subjection to the chipping operation in the cutting chamber 32. It should however be understood that it is within the scope of the present invention that the means for driving at least one of the rollers 70 and 72 may comprise various other suitable means such as, for example, electric motors or mechanical motors utilizing power (in-line) from a tractor to which the wood chipper 30 is hooked up. Another suitable means for driving at least one of the rollers 70 and 72 may comprise the drive means will be described hereinafter with reference to FIG. 17.

The in-feed rollers 70 and 72 (wherein one or both may be driven, as discussed hereinafter) constitute a means for feeding wood into the chamber 32 or other wood-chipping means. However, other such means for feeding wood are envisioned, such as the means for feeding wood shown in the aforesaid U.S. Pat. No. 7,878,434, wherein an in-feed hopper is shown but no in-feed rollers provided, and such other means for feeding wood are meant to come within the scope of the present invention as defined by the appended claims.

Figure 16:
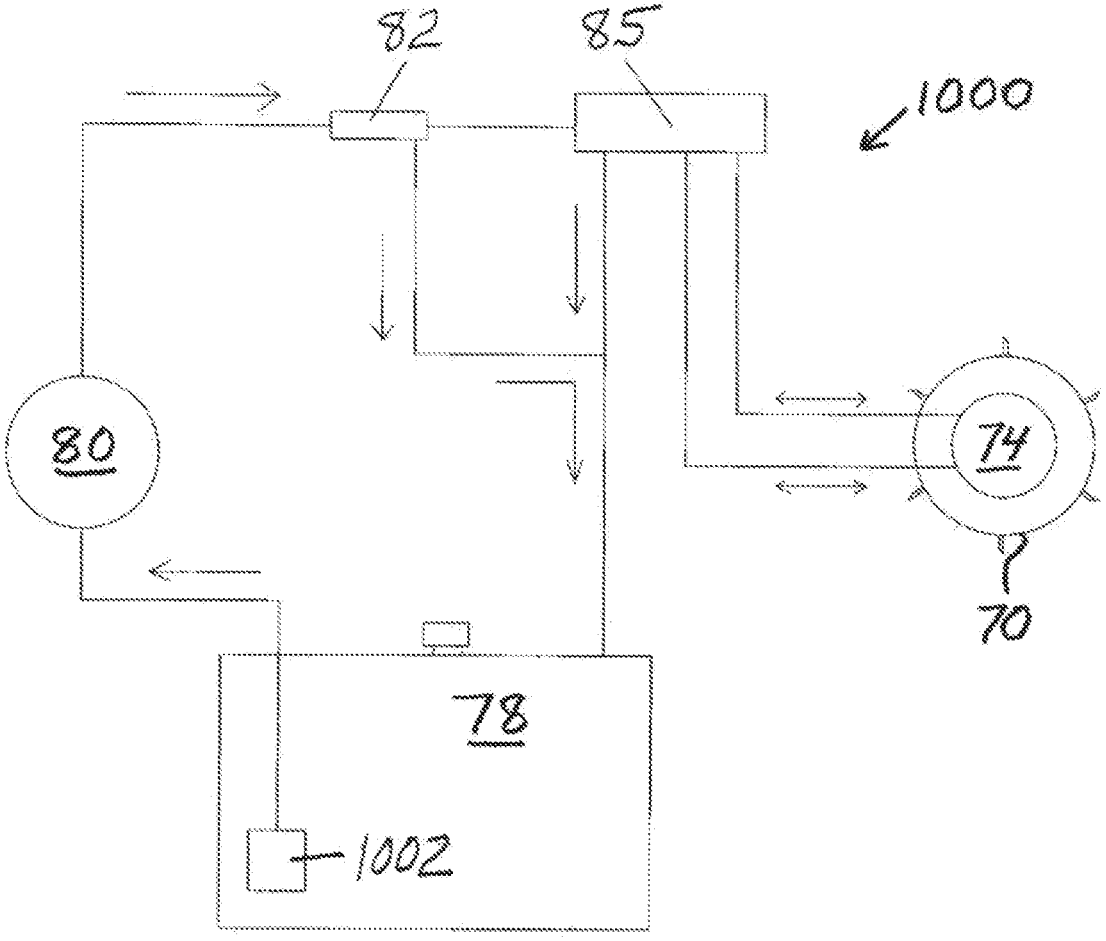
PRIOR ART FIG. 16
FIG. 16 is a schematic view of the hydraulic system, in accordance with the prior art, therefor.

The hydraulic system for the motors 74 and 76 is self-contained and includes a hydraulic fluid reservoir tank 78 suitably associated with a hydraulic fluid filter 1002, hydraulic fluid pump 80, and hydraulic fluid lines (illustrated in FIG. 16 with the direction of fluid flow illustrated with un-numbered arrows, which are easily understood by one of ordinary skill in the art to which the present invention pertains) including controller 85 for routing the hydraulic fluid as appropriate to the hydraulic motors 74 and 76 for suitable operation thereof. Thus, there is desirably no need to rely on the tractor or other source for supplying hydraulic power. The tank desirably has a capacity of about 38 liters/7 gallons. The hydraulic motors 74 and 76 are desirably mounted utilizing a standard SAE 2-hole A mount, which, if there is a need to replace the motor, it has such a standard mount that it can be found just about anywhere. The motors 74 and 76 are desirably variable speed (0 to 40 feet per minute) aggressive dual counter rotating reversible to cause the rollers to work together to pull material into the cutting housing 32, to allow the user to slow the in-feed speed down to accept large wood material and to also help to regulate the chip size as well as allowing reversal of the motors if necessary. Hydraulic flow control valve structure is illustrated at 82. The powering of the pump 80 will be described hereinafter. Hydraulic hoses for the hydraulic system desirably utilize the SAE, JIC (Joint Industrial Council) standards which are widely used in fluid power applications throughout the United States and Canada, with the result that replacement hoses can be made just about anywhere. Since the operation and control of hydraulic fluid for powering and control of the motors 74 and 76 are within the knowledge and skill of one of ordinary skill in the art to which the present invention pertains, the hydraulic system will therefore not be described in further detail herein.

Illustrated at 84 is a manually operable bar suitably connected to the valve structure 82 and pivotally attached, as at pivots 86, to the in-feed hopper 66 in a manner within the knowledge and skill of one of ordinary skill in the art to which the present invention pertains to perform the following operations. The bar 84 may be provided to have an upper position for in-feed rotation, as illustrated in FIG. 2 at 865, a neutral position, and a lower position for reverse rotation (which may, for example, be used if jamming occurs). The neutral position is provided for safety, i.e., to disengage the in-feed rollers in an emergency and is also provided to clear the in-feed bin if necessary. Thus, the easy to activate bar 84 located on the top of the in-feed bin may be pulled up to suitably actuate hydraulic valves for rotating the rollers 74 and 76 in the in-feed directions 865 for suitably deforming the wood and feeding the suitably deformed wood into the cutting chamber 32, the bar 84 may be pulled down to the neutral position to stop the in-feeding, the bar may be pulled further down to reverse the roller rotation for un-jamming the wood chipper 30 or the like, the bar 84 may be pulled back up to the neutral position, and the bar 84 may be pulled up to again conduct the in-feeding.

The structure 89 supporting the upper roller 70 is suitably formed, using principles commonly known to those of ordinary skill in the art to which the present invention pertains, to allow the upper roller 70 to move vertically as needed for different sizes of wood, and the adjustment of the gap between rollers 70 and 72 is discussed hereinafter. For manual accommodation of large chunks of wood, a pair of elongate members 88 which are suitably attached to and extend vertically from the support structure 89 on each side of the upper roller 70, and their upper ends are suitably joined by an elongate member 90 thereby forming a yoke for the upper roller. Suitably attached to the member 90 centrally thereof is one end of a chain 92. An in-feed roller assist handle bar 94, which may desirably be accessed from either side of the wood chipper 30, has an elongate member 95 which is suitably pivotally attached, as by a pair of suitable pivots one shown at 96, to an upper plate of the in-feed bin 66 or otherwise as suitable. One end of an elongate member 98 is suitably attached centrally of the member 95, and the chain 92 is suitably attached to the other end thereof. This center lift point allows the wood chipper 30 to use stronger tension springs (300 in FIG. 2 and discussed hereinafter) to increase in-feed ability.

In order to allow large chunks of wood to be fed between the rollers 70 and 72, the upper roller 70 is raised by pushing downwardly on the handle bar 94, as illustrated at 100, which effects pivoting of the member in the direction illustrated at 102, which pulls on the chain 92 to lift the vertical members 88 thereby moving the upper roller 70 thus increasing the space between the rollers 70 and 72 to accommodate large chunks of wood. However, this mechanism with lever 94 may be desirably eliminated if an improved in-feed roller 70 is provided, as discussed hereinafter in connection with FIG. 14.

A suitable support structure 104 is suitably attached to the cutting chamber 32 and is supported by four legs 106. The wood chipper 30 is provided to be quickly pitchable to a tractor as discussed hereinafter. Illustrated at 108 is a drive pulley suitably bearingly received on the support structure 104 in accordance with principles commonly known to those of ordinary skill in the art to which the present invention pertains. For receiving power from a tractor, the drive pulley 108 is attachable to the power take-off of the tractor by means of the splined protrusion 22 containing the splines 20. For the wood chipper 30 discussed herein, the minimum power take-off horsepower is considered to be 19 horsepower at a speed of 540 rpm. The drive pulley drives pulley 110 for rotating the flywheel 24 within the cutting chamber 32 and for the pulley 112 for powering the hydraulic pump 80 via suitable belts 114 and 116 respectively or by other suitable means. The pulley 112 is suitably connected to the hydraulic fluid pump 80 by means of a suitable shaft at 118 which is suitably bearingly supported in accordance with principles commonly known to those of ordinary skill in the art to which the present invention pertains. The drive belts 114 and 116 are desirably heavy duty cogged 17 mm wide belts, which can generally be purchased at any auto parts store (whereas the 15 mm belts typically used in chippers are hard to find in the United States).

Figure 8:
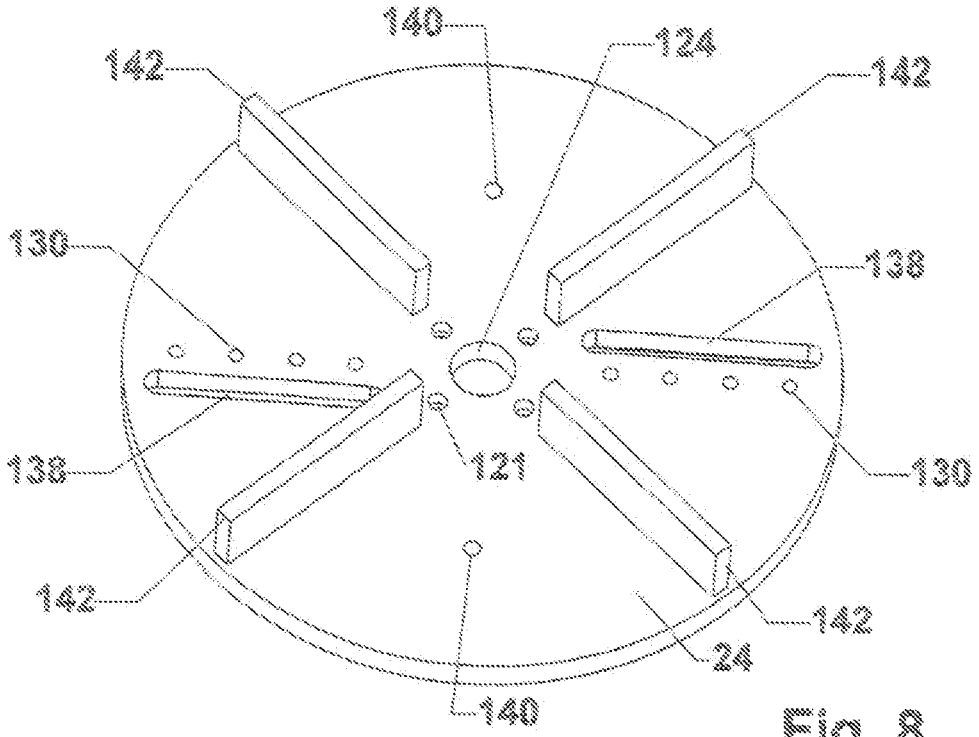
FIG. 8 is a perspective view of the flywheel, in accordance with the prior art, showing the back side thereof.
Figure 9:
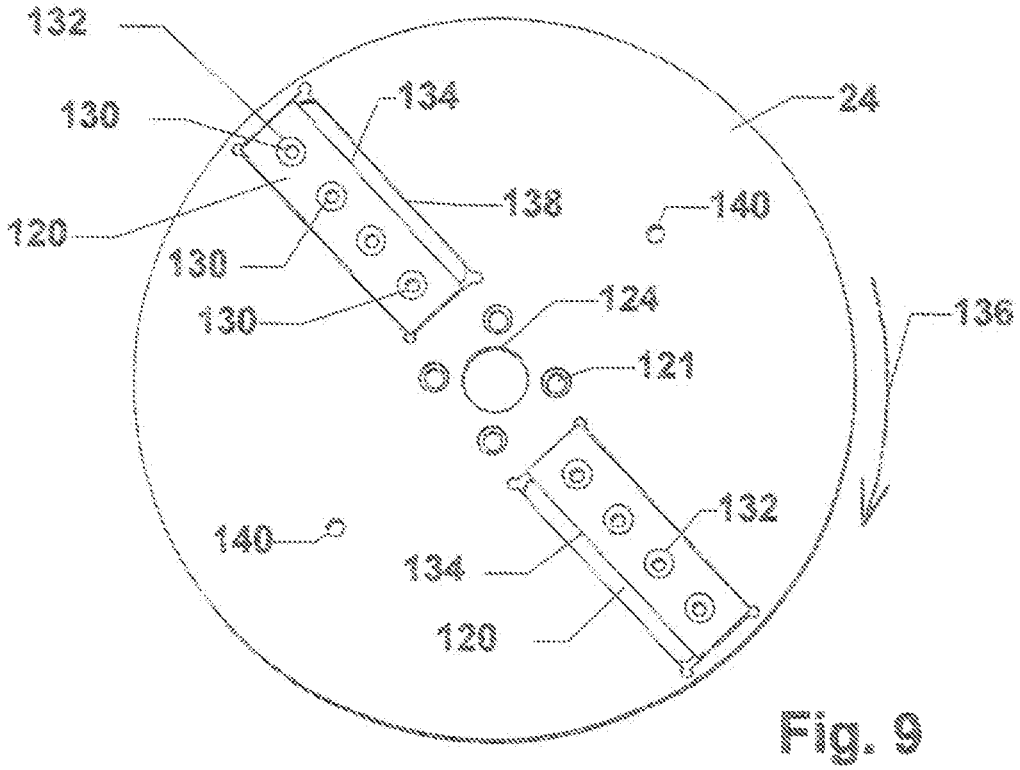
FIG. 9 is a plan view of the face side of the flywheel, in accordance with the prior art.

Referring to FIGS. 8 and 9, the disc-shaped flywheel 24 which is rotatably contained within the cutting chamber 32 and which contains the cutting knives 120 (for example, two diametrically opposed such knives 120) desirably has a weight of about 200 pounds to deliver the energy to deftly chip all types of wood material and desirably has a diameter of about 24 inches. This weight has been found to be ideal since larger flywheels do not produce optimal effects when used with tractors with less than 40 horsepower at the in-feed opening size, and since larger flywheels require more horsepower to turn, which reduces chipping capacity and efficiency, i.e., in such wood chippers with heavier flywheels, more horsepower is accordingly undesirably diverted into turning the heavier flywheel instead of chipping the branches of wood.

A shaft 122 connects the pulley 110 to the flywheel 24. In order to allow for suitably large and strong bearings for support thereof, as hereinafter discussed, the shaft 122 desirably has a diameter of about 2 inches (50 mm) for providing suitable durability. The shaft 122 is received in flywheel central hole, illustrated at 124 (FIGS. 8 and 9), and is suitably attached to the flywheel by bolts or other suitable fasteners (not shown) received in apertures, illustrated at 121, in the flywheel and threadedly received in corresponding apertures (not shown) in a flange (not shown in FIGS. 8 and 9, but shown at 1902 in FIG. 19) machined onto the shaft 122.

Referring to FIG. 1, the shaft 122 as it passes through flywheel back housing plate 36B is suitably supported by two flange bearings 126 (one on each side of the plate 36, one shown). The shaft 122 is also suitably supported adjacent the pulley 110 by a conventional pillow block 128. These bearings 126 and 128 are desirably heavy duty, shock resistant cast steel bearings (which are more durable than conventional cast iron bearings). Combined with the greater diameter shaft, this allows the flywheel 24 to run more true and is provided to add a great deal of strength. This is compared to conventional chippers which use a 1¾ inch shaft with two pillow block bearings and in which the flywheel is cantilevered beyond the bearing, a setup in which there is a possibility of breaking a bearing housing if the wood chipper jams. To give added strength and rigidity in view of the more robust shaft 122 and bearings 126 and 128, the cutting chamber plates 38 are suitably composed of about 5/16 to ⅜ inch thick steel (instead of ¼ inch conventional thickness thereof).

Figure 5:
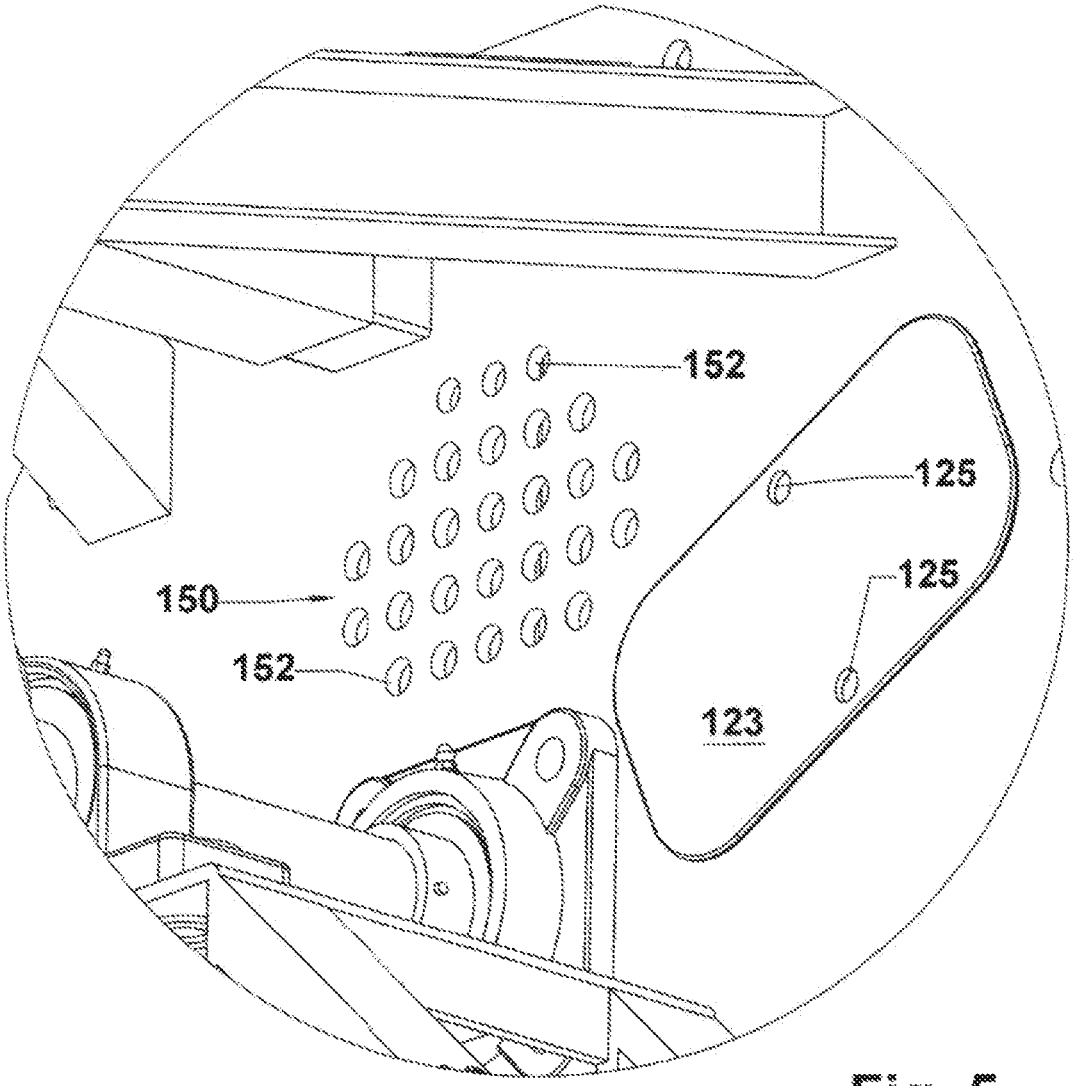
FIG. 5 is view similar to that of FIG. 2, illustrating the pattern of vent holes in the flywheel housing for sucking air into the flywheel housing.

Referring to FIG. 9, on the face side (facing the front plate 36F and inlet feed of the wood), the two knives 120 are desirably reversible double-edgee knives (but may be single-edge knives), supporting blade edges 134. Each knife 120 is fastened into a milled pocket (not shown) in the flywheel, with suitable fasteners, for example, four machine screws at 130 received in apertures in the flywheel 24 and securely threadedly received in longitudinally spaced threaded apertures, illustrated at 132, in the knife 120. High quality flywheel knives and knife screws are considered very important for a chipper to work efficiently and safely as well as to provide superior life and performance. Accordingly, the knives 120 are desirably composed of suitably heat treated, thoroughly hardened, high carbon, high chromium, A-8 tool steel, and the screws 130 are desirably class 12.9 Holo-Krome thoroughly hardened machine screws or other suitable fasteners. The knives 120 are installed so that the heads of the machine screws at 130 face the back plate 36B so that they can be easily replaced by reaching in an access hole 121 (shown uncovered in FIG. 10) in the back plate 36B with a screwdriver. FIGS. 1 and 5 shows the access hole 121 suitably covered with a plate 123 and screws 125. The milled pocket is provided for added strength to thereby allow the use of the machine screws at 130 (instead of bolts) as the fasteners. Alternatively, the machine screws 130 may be received in holes in the knives 120 and threadedly received in threaded apertures in the flywheel 24 whereby the knives may be replaced by reaching through the in-feed with a screwdriver. Thus, the machine screws 130 are provided to allow the knives 120 to be changed from one side of the wood chipper 30 by one person (instead of the use of bolts which require one to reach into the in-feed bin to hold the head of a bolt while someone else turns the nut from the back side of the flywheel).

The knives 120 are positioned to support leading edges 134 for cutting as the flywheel 24 rotates in the direction illustrated at 136. The knife edges 134 are positioned so that the chips cut by the knife edges 134 fall through slots, illustrated at 138, in the flywheel 24 to the back side thereof. The purpose of holes 140 is to provide markers on both flywheel sides in order to position the flywheel 24 for accurately aligning machining processes.

Proper knife gap is important so that even the smallest material is chipped as it passes through the wood chipper. In order to provide proper gap, illustrated at 133, with the wood feed bed, the wood chipper 30 is suitably equipped with an adjustable bed knife 125 to allow the user to adjust the gap 133 between the flywheel knife blade edge 134 and the bed knife (anvil knife) blade edge 127. To adjust the gap 133, the bed knife 125 is suitably assembled to the bed 131 to be adjustably movable back and forth in the direction illustrated at 129, i.e., to and from the flywheel knife edge 134 to reduce and increase the gap 123 respectively. If the gap 133 is too large, for example, larger than 0.03 inch, the chipper will not chip as finely as desired, and the larger chips created can clog the discharge chute. If the gap 133 is too small, for example, less than 0.02 inch, interference between the steel flywheel revolving blades and the bed blade may occur, causing severe damage to the blades. Therefore, in order to be in a range where it is not too large or too small, the bed knife 125 is movably set on the bed 131 so that, preferably, the gap 133 is adjustable to be within the range of about 0.02 to about 0.03 inch (more preferably, about 0.020 to 0.030 inch). With the bed knife thusly movably set on the bed 131, the gap may desirably be more finely adjusted to achieve the ideal gap within the gap range.

Referring to FIG. 8, a plurality of blades 142, which may be called fan blades, in the form of elongate plates are welded or otherwise suitably attached to the flywheel and extend radially of the flywheel 24 from generally the center thereof to the outer edge thereof, with the width thereof extending axially outwardly thereof to leave a gap between each blade 142 and the back plate 34B which is desirably as small as possible but sufficient to prevent contact between the rotating blades 142 and the back plate 34B. For example, there are four such fan blades spaced at about 90 degrees around the flywheel circumference and spaced about 45 degrees from the respective nearest slot 138 so as to optimally time the passage of chips through the slot relative to the movement of a blade 142 to sweep and eject the chips from the cutting chamber, as discussed for fully hereinafter in conjunction with FIGS. 5 and 10.

The flywheel and knives constitute a means for chipping wood. However, other such means for chipping wood are envisioned, such as the means for chipping wood shown in the aforesaid U.S. Pat. No. 7,878,434 as well as in FIG. 19 hereof along with the accompanying description, and such other wood chipping means are meant to come within the scope of the present invention as defined by the appended claims.

1. Ventilation Holes

The aforesaid U.S. Pat. No. 7,878,434 shows in FIG. 7 thereof an arrangement of 6 horizontal rows each having 4 apparently rectangular holes in a chipper disk housing back plate, the hole arrangement being vertically above the chipper disk shaft, and appears to be offset to the left of the chipper disk shaft. This arrangement is believed to result in reduced air intake efficiency because the placement of the hole pattern is too far from the center of the shaft and too close to the upper wall of the chipper disk housing, and it is believed such a location of the hole pattern too close to the upper wall of the chipper disk housing significantly conflicts with exhaust air as increased air pressure is created as a fan blade spins at greater speed at its outer perimeter.

Figure 10:
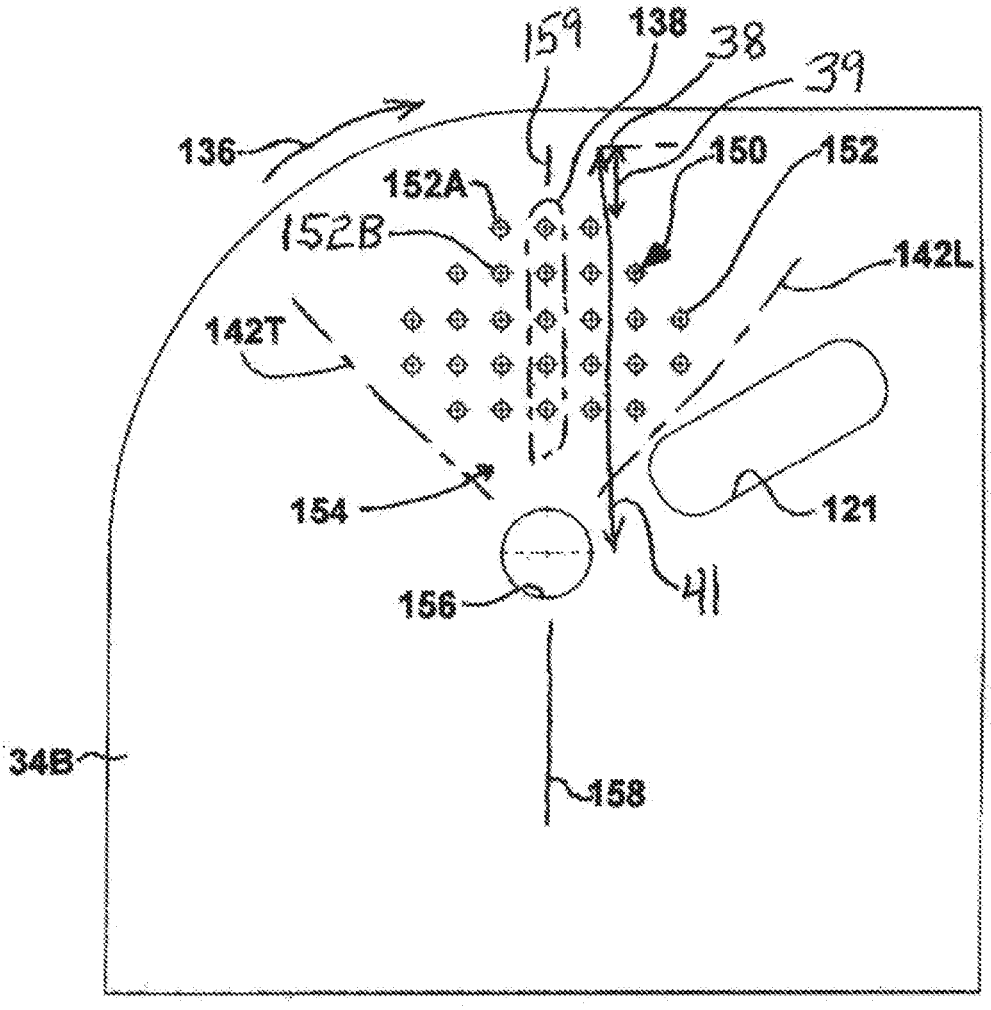
FIG. 10 is a plan view of a portion of the flywheel housing, illustrating the pattern of vent holes therein.

Referring to FIGS. 5 and 10, there is shown at 150 an arrangement in accordance with the present invention of ventilation holes 152 in the back plate 34B for providing high efficiency air intake into the flywheel chamber 32 in order to create a strong vacuum that draws air into the flywheel chamber 32 and, in combination with the fan blades 142 which are closely spaced with the back wall 36B, forcefully eject the chips out of the chamber 32, keeping the discharge chute clear. In FIG. 10, for illustration purposes, a chip passage slot 138 and two fan blades 142 are illustrated in phantom lines at a point in time during rotation of the flywheel 24 in the direction 136. It should be noted that, since the fan blades 142 are at right angles to each other, there are 90-degree sweeps of chips. Thus, after a leading blade 142L has completed a sweep, the trailing blade 142T becomes the leading blade, as illustrated in FIG. 10, and sweeps and ejects the chips that have passed through slot 138 after the blade 142L has passed the slot 138 and the chips which pass through the slot 138 during the first half of its sweep. The power for ejecting the chips comes from air received through the ventilation holes 152, and the chips are entrained in the air for ejection by the fan blades 142 under the force generated by rotation of the flywheel. The passage of the leading blade 142L during its sweep applies force to air in the 90-degree sweep quadrant, illustrated at 154, to eject the air already in the quadrant from a previous sweep, with the chips entrained therein. As a blade 142 passes over holes 152, it sucks air in through holes 152 over which it has already passed, providing air to be ejected with entrained chips by the next blade 142 for the following sweep. It should be understood that the above and other statements of theory contained herein are not to be considered statements of fact but are to be considered as the opinion of the inventor.

It should therefore be apparent from FIG. 10 that the critical positioning of the holes 152 is within the quadrant 154 of a sweep, i.e., for the four fan blades 142, it would be over the 90 degree arc (defined by the fan blade positions illustrated at 142L and 142T in FIG. 10) directly above the aperture, illustrated at 156, in which the flywheel shaft 122 is received, with the holes generally equally positioned to both sides of a vertical line, illustrated at 158. It has been found that the ejection of chips is more effective with the holes 152 centered at this top dead center, illustrated at 159, where the vortex generally starts. It should be understood that if a wood chipper has the hole arrangement 150, additional holes would still come within the scope of the present invention. Thus, while the middle three vertical rows each are shown to have 5 vertically spaced holes, the row to each side thereof does not have a hole corresponding to hole 152A and the row to each side of these does not have holes corresponding to either of holes 152A or 152B. This is because it has been found that holes in these locations were not much more effective. More holes 152 are preferred close to the shaft vertical line because there is more suction there. A hole 152 too close to the opening 121 would not be desirable. The ventilation hole pattern 150, centered horizontally, has its upper row of holes 152 spaced vertically from the upper portion of the plate 38 (illustrated in phantom lines in FIG. 10) a distance, illustrated at 39, of at least about 1 inch, preferably about 2½ inches (which may be about 4 inches from the top of the flywheel housing back plate 36B). Such a location of the hole pattern 150 spaced from chamber plate 38 the distance 39 is provided so that the upper holes 152 do not significantly conflict with exhaust air as increased air pressure is created as a fan blade spins at greater speed at its outer perimeter, to thereby provide increased efficiently. This distance 39 is equal to at least about 10 percent (preferably about 20 percent or more) of the height or distance, illustrated at 41, between the center of the hole 156 and the upper wall of the plate 38.

Each hole 152 desirably has a large diameter, but it is also desired that the hole diameter not be so large that one can stick his finger in the hole. Accordingly, the diameter of each hole 152 is preferably about 12 mm. The spacing between holes 152, both vertically and horizontally, is preferably at least about 35 mm in order to efficiently provide adequate air distribution and so that the enlarged boundaries of the hole pattern would not easily become blocked by foreign objects. However, the spacing between holes 152 is desirably not so large as to significantly reduce the total volume of air intake. Thus, an ideal spacing between holes 152 is considered to be about 35 mm. The holes 152 are preferably circular in order to provide manufacturing efficiency. The hole arrangement 150 comprises at least 27 holes 152 arranged generally symmetrically relative to the shaft vertical center line 158, desirably providing about 3,053 square mm (about 4.7 square inches) of surface area for providing highly efficient suction of air into the flywheel chamber for ejection of chips entrained in the air. For example, the ejection may be as much as a distance of 25 feet as compared to 15 feet for a 9-hole pattern hole arrangement. In order to maximize air intake and chip ejection efficiency, there are at least 4 equally circumferentially spaced fan blades 142, but the added efficiency of more than 4 fan blades is believed to be negligible.

2. Adjustment of Hydraulic Pump Belt Tension

Figure 3:
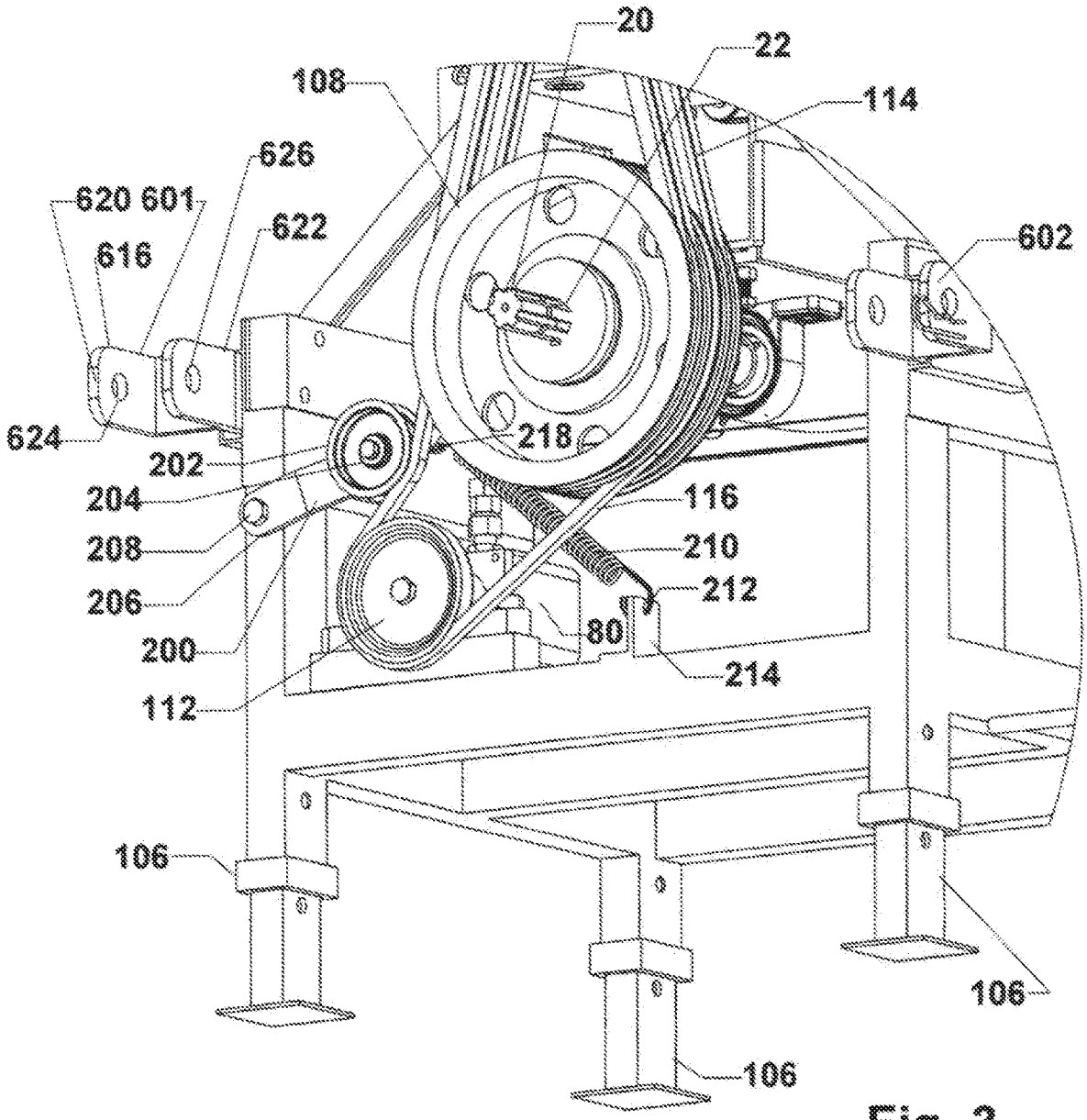
FIG. 3 is a view similar to that of FIG. 2, illustrating the drive structure for the flywheel and legs for the wood chipper.

If not otherwise adjusted, the hydraulic pump belt may need periodic manual adjustments due to expansions and contractions and the like. Referring to FIGS. 1 and 3, in order to provide automatic adjustment of the hydraulic pump belt 116, in accordance with the present invention, an automatic belt tensioner 200 is provided for keeping constant pressure on the belt 116, so that the user does not have to adjust it, thereby to increase the longevity of the pump 80 while saving the user the hassle of constantly having to adjust it. The tensioner 200 comprises a pulley 202 which is positioned to constantly press against the belt 116. The tensioner 200 has a shaft 204 about which the pulley rotates, a plate 206 suitably connected to the shaft 204 and suitably attached to the support structure 104 such as by a bolt or other suitable fastener 208, and a spring 210 suitably attached to the shaft such as by bracket 216 with hole 218 and to the support structure 104 such as by bracket 214 with hole 212. The spring 210 provides a constant pressure which is selected to be enough to hold enough pressure on the belt 116 during expected expansions and contractions but not so much that there is bearing failure.

3. Means for Applying Pressure to the Upper In-Feed Roller and In-Feed Roller Gap Adjustment Referring to FIGS. 1 and 2, a pair of high tension springs 300 (one shown) are each connected at its lower end to a bracket 302 having spring receiving hole at 304 and at its upper end to an elongate adjusting member 306 having at one end portion spring receiving eye 308. The other end portion 310 of the adjusting member 306 is threaded, and this threaded portion 310 is received in an aperture of a bracket 312 welded or otherwise suitably attached to the respective member 88 (which is suitably attached to the upper roller assembly to allow the upper roller to be raised or to allow pressure to be applied by the upper roller to the lower roller). A pair of nuts 314 (one below and one above the bracket 312) are threadedly received on the threaded portion 310 for adjusting the downward pressure applied to the upper roller via member 88. This adjustment via member 306 is provided to allow the user to increase the upper roller down pressure (desirably to achieve up to about 165 pounds of down pressure) to cause the cutting blades (hereinafter discussed) on the upper roller to dig into the branches of wood and ensure a smooth entry into the chipper in-feed head or to decrease the down pressure. If the wood material is hard, more down pressure is needed, and if the wood material is soft, less down pressure is needed. This thus allows use of the wood chipper 30 for chipping a wider variety of wood.

The springs 300 constitutes a means for applying pressure to the upper in-feed roller 70. However, other means for applying pressure to the upper in-feed roller are envisioned, such as the single spring 800 discussed hereinafter with respect to FIG. 13 and the gas springs 1800 discussed hereinafter with respect to FIGS. 18, 20, and 21, and such other pressure applying means are meant to come within the scope of the present invention as defined by the appended claims.

An elongate plate 316 is suitably attached at one end to the upper roller assembly 89 and its other end is suitably pivotally attached at 318. In order to adjustably provide a limit to the gap, illustrated at 320 in FIG. 7, between the upper and lower rollers 70 and 72 respectively, in accordance with the present invention, a member 322 is welded or otherwise suitably attached to the plate 316, and a bolt or screw 324 is threadedly received in a nut 326 then in the member 322 attached to the threaded plate 316 and with its head 328 resting on the plate 302. The nut 326 provides an adjustable stop to limit the gap 320, and this gap limit may, for example, be adjusted between ⅛ inch for smaller wood and 1½ for larger pieces of wood, so as to optimize efficiency no matter what size the wood is.

4. In-Feed Rollers

Figure 6:
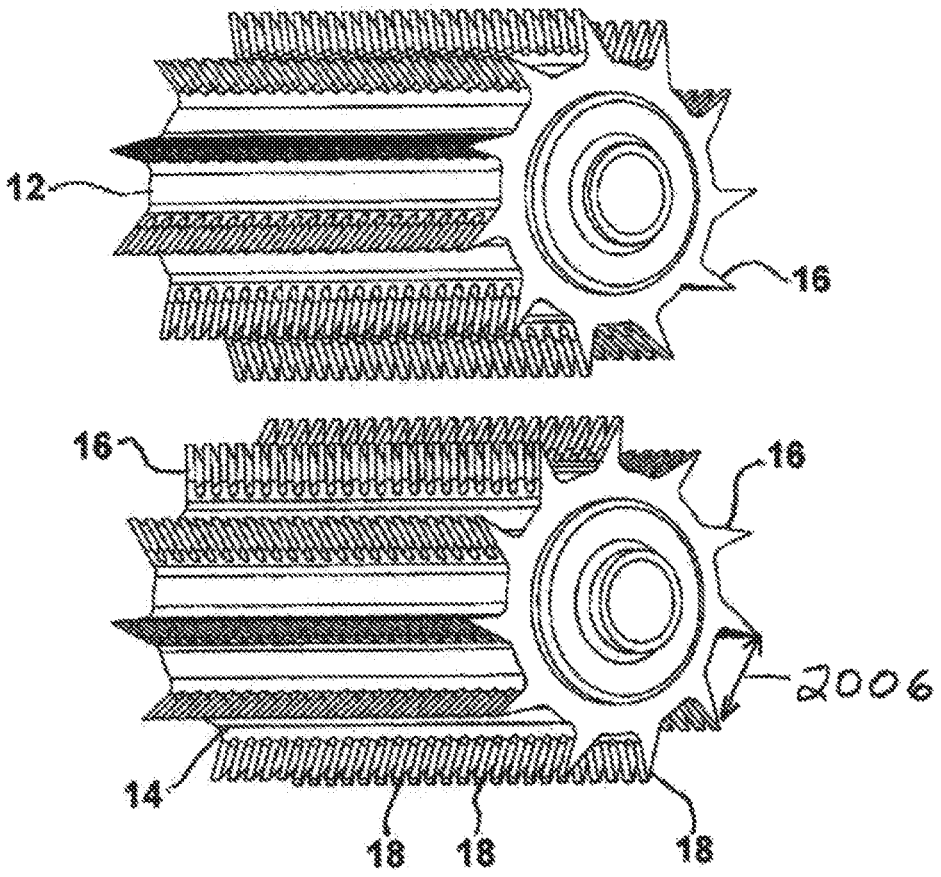
PRIOR ART Fig. 6
FIG. 6 is a perspective view of upper and lower in-feed rollers in accordance with the prior art.

As previously discussed with regard to FIG. 6, typical prior art upper and lower rollers 12 and 14 respectively for wood chippers are identical, each having circumferentially spaced chisel portions 16, wherein each chisel portion 16 is formed of a plurality of teeth 18 spaced lengthwise thereof. The teeth 18 undesirably grab and trap vines and leaves impacted thereon causing jamming, resulting in substantial work to clean the material from them.

Figure 7:
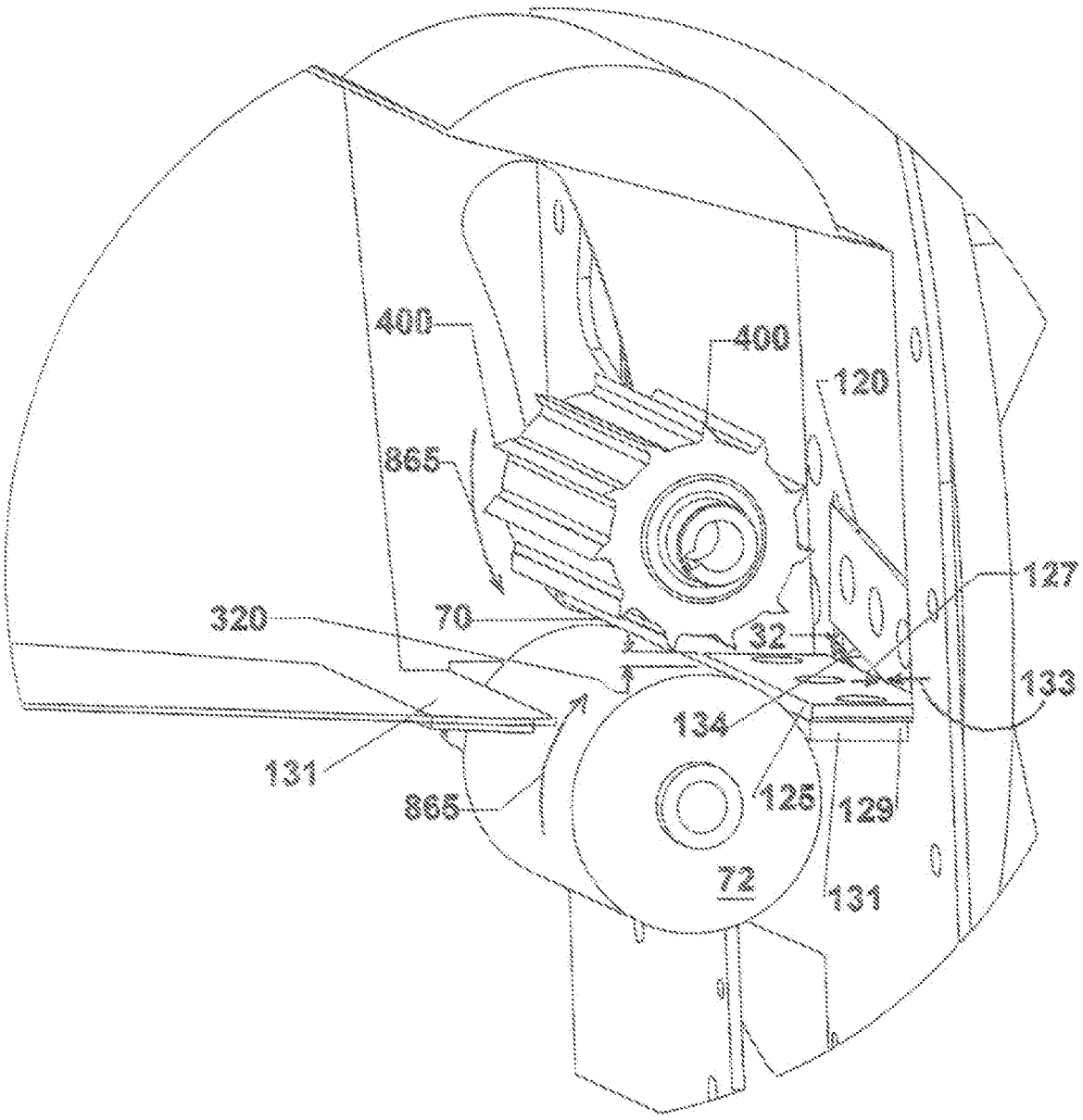
FIG. 7 is a perspective view of a wood feed bed portion of the wood chipper illustrating upper and lower in-feed rollers in relation to the bed in accordance with the present invention.
Figure 14:
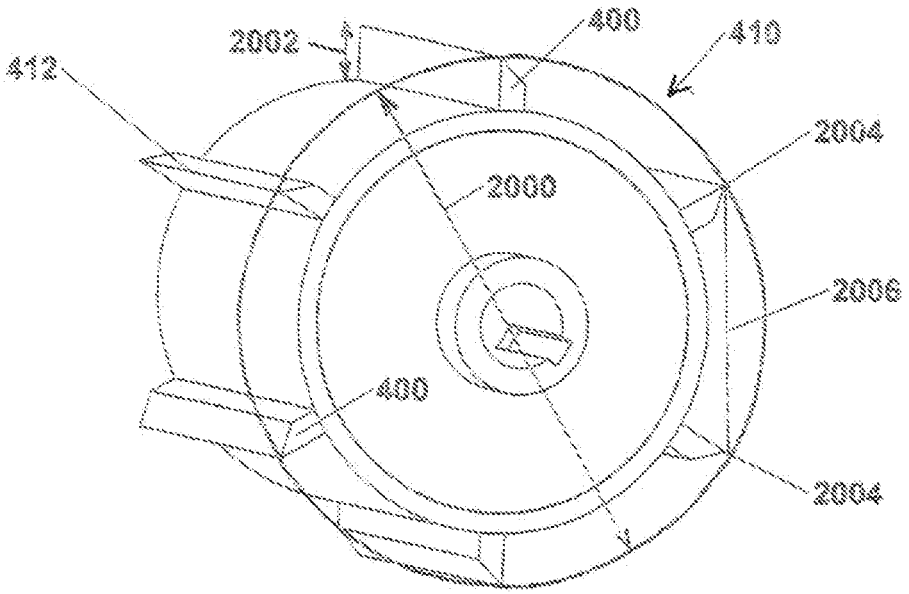
FIG. 14 is a perspective view of an alternative embodiment of the upper in-feed roller of FIG. 7.
Figure 15:
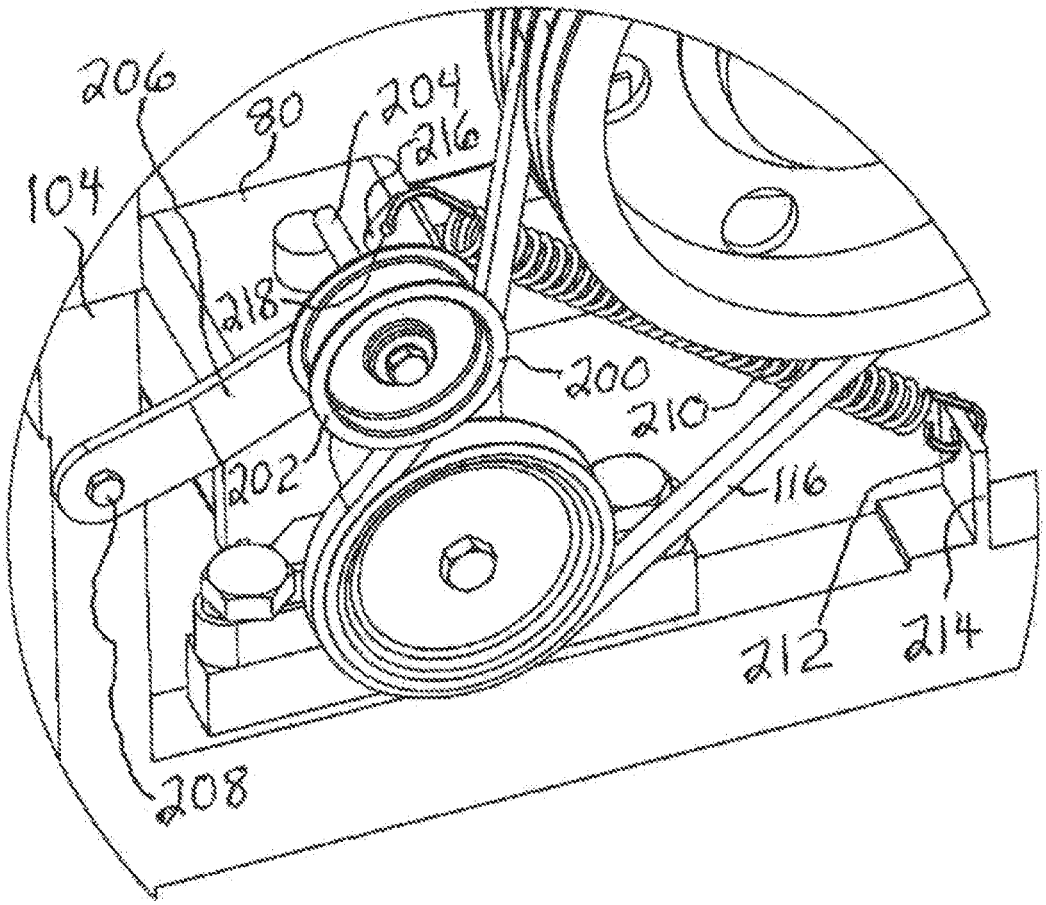
FIG. 15 is a view similar to that of FIG. 3 showing a close-up view of a hydraulic pump belt tensioner from a different perspective.

Referring to FIG. 7, in accordance with the present invention, in order to prevent or substantially reduce such trapping of vines and leaves and the like so as to alleviate the difficulty of having to clean such material from the in-feed rollers, the lower roller 72 is a smooth roller, and the upper roller 70 is formed to have a plurality of circumferentially-spaced elongate chisel portions 400 each extending lengthwise the entire length (or at least substantially the entire length) of the roller 70. These rollers 70 and 72 are provided to grab wood material and effect its movement into the chipping chamber. Thus, unlike the rollers 12 and 14 of the prior art (FIG. 6) wherein each circumferentially spaced chisel row 16 is composed of teeth 18, the chisel portions 400 of the present invention are un-notched in a direction radially of the roller 70 or otherwise formed to have such teeth. Thus, while a chisel portion 400 is seen in FIG. 7 to have a series of alternating surfaces and edges each extending longitudinally over the entire length thereof, there are seen to be no notches extending in a direction radially of the roller 70 into the chisel portion. As a result, there are no teeth in the chisel portions 400 like the teeth shown at 18 in the chisel rows 16 of the rollers of FIG. 6. The upper roller 70, which may have a total diameter of, for example, about 6.25 inches, has typically contained, for example, 8 to 12 such chisel portions 400, circumferentially spaced about the circumference thereof. Discussed hereinafter with respect to FIG. 14 is an improved embodiment thereof. By "smooth roller" is meant that the engaging or circumferential surface of the roller is smooth, i.e., it has no chisel portions or toothed projections like teeth or any other cutting or tearing blades or means. The chisel blades 400 are suitably angled in the direction of rotation of roller 70 to bite into the wood as the rollers rotate in directions 865.

The lower smooth roller 72 is composed of steel or other suitable material. The upper roller 70 has a roller portion of annealed softer steel with the chisel portions 400 composed of a harder high carbon steel welded thereto, or is otherwise suitably composed. The rollers 70 and 72 along with the high tension springs 300 are provided to aggressively bite into any type of wood material, and it has been found that the chisel portions on only the one roller 70 provides the desired quality of biting into wood material. The chisel portions 400 are desirably induction hardened to ensure that they stay sharp for many years. Such a roller 70 is provided to aggressively grab any size limb up to about 8 inches diameter, with or without leaves, and so that vines, leaves, and small branches do not wrap around the roller 70 as they might on chippers having the prior art rollers 12 and 14 (FIG. 6).

The variable speed (0 to 75 feet per minute) aggressive dual counter rotating hydraulic-powered in-feed rollers 70 and 72 (wherein roller 72 may be an idler roller, as discussed herein elsewhere) are provided to work together to pull material into the chipper head, i.e., chipping chamber. This allows the user to slow the in-feed speed down to accept large material and is also considered helpful to truly regulate the chip size. The rollers 70 and 72 are reversible. As discussed hereinafter with respect to FIGS. 18, 20, and 21, the lower smooth roller 72 may, if desired, be alternatively an idler roller.

Referring to FIG. 14, there is shown at 410 an alternative and improved embodiment of the upper in-feed roller 70, wherein the upper in-feed roller 410 has a lesser number of chisel portions 400 having blade edges 412, such as, for example, six such portions. The lesser number of chisel portions 400 (with the correspondingly greater spacing circumferentially between chisel portions 400) is provided to allow wood materials to be more easily grabbed and fed during initial insertion, as discussed more fully hereinafter. It is believed that this is because downward force placed upon one or two chisel edges 412 cuts deeper into wood material than would happen with more than 2 chisel edges. With more than 2 chisel edges engaging the wood at the same time, the downward force is more divided and therefore less effective. Thus, it is believed that the resultingly greater efficiency of the roller traction equals more positive wood material feeding into the chipper chamber. However, it is believed that as the number of chisel portions for this size roller (diameter of 6¼ inches) is reduced below five or increased above seven, the effectiveness of the roller 410 would quickly drop off.

The reason why rollers with, for example, 11 circumferentially spaced blades for a 6¼ inch diameter roller, as seen in FIG. 6, is not as effective as desired is that the number of chisel knife edges reside at a point-to-point distance or tip-to-tip distance, illustrated at 2006, which is less than the desired distance for the greater effectiveness discussed herein. The greater number of blades on such conventional rollers undesirably allow more than one or possibly 3 knife edges to attempt to advance the wood material at the same time. Assuming a total of 120 to 160 pounds of force being exerted on the wood material from the gas springs 1800 (discussed hereinafter), or by other springs 300 or 800, directing those roller forces upon the wood, those forces would be then divided by the number of knife edges that are in contact with the wood material at the same given moment. Therefore, less force can be applied on a singular knife edge, thus not allowing the knife edge to dig as efficiently as desired deep enough to provide a sufficiently desired tractional force against the wood material for feeding into the chipping flywheel without slipping. With multiple knife edges attempting to advance irregular shaped branches, these multiple knife edges can work against each other, each minimizing the down force that can be ultimately applied. Also, for wood branches, it is typical that the material under the bark, once it is removed, has a smooth and slippery wood surface. If the bark is eroded through repeated rotary action of an in-feed roller "skipping" across the branches, it can easily remove the bark exposing the slippery wood material underneath. Once this happens, the in-feed action would require even more than the intended amount of down force for even the sharpest of knife edges to penetrate the wood in order to provide an adequate force against the chipping flywheel. For this reason, additional spacing between knife edges would desirably concentrate the down forces upon one advancing knife edge for a longer period of time of travel. This enables one knife edge to more effectively dig into the wood no matter what the wood's shape is. Thus, with the greater number of blades of the prior art, the faster advancing follow-up knife actually may disadvantageously aid in dislodging the prior knife edge's "bite," as it takes away down forces from the first knife edge as it also attempts to "bite." The prior knife edge then loosens its grip due to the reduced available force and undesirably dislodges more quickly. The follow-up knife must now undesirably have to create its own bite and may even more undesirably be limited in its ability to do so until the previous knife edge is fully disengaged. This may undesirably cause skipping and erratic material advancement of the blades over the wood.

Additionally, a wider knife spacing may desirably allow the rotating feed roller to more easily lift itself or "crawl up" to the top of larger materials that are manually placed into the hopper. It is imperative that, in order for the feed roller to work, it must be on top or above the wood to be chipped. Again, closer knife edge spacing undesirably creates a skipping effect while wider spacing desirably allows one edge to engage without the next one forcing it out of its foothold as it attempts to climb the wood end.

The wider blade spacing effectively and desirably allows the elimination of the manual lift lever 94 (FIG. 1) which is shown as employed in FIG. 1 and which many machines employ to assist the in-feed roller to engage on top and advance wood underneath. Without the roller's ability to crawl up on top of the wood unassisted, the operator is required during operation of these machines to undesirably constantly lift the in-feed roller lever 94 to assist feeding larger or many sized materials to engage the in-feed roller. Such needs to engage wood materials that are placed into the hopper undesirably cause work delays, as the operator must attend to the machine instead of finding and inserting the next branch.

However, if the spacing between the blades is too great, effectiveness also undesirably drops off. Thus, before one blade engages the wood, the earlier blade has already revolved beyond its effectiveness. It is thus desirable for greatest efficiency and effectiveness that one blade engage before the previous one disengages. A loss of wood contact leads ineffectively to slippage. Therefore, it is very important, to achieve the desired effectiveness, that the number of blades for a given size roller not be too many or too little.

The diameter, illustrated at 2000, of roller 410 (FIG. 14) is, for example, about 6¼ inches, and the diameter of each of the prior art rollers 12 and 14 (FIG. 6) is also about 6¼ inches. In addition to that diameter, typical roller diameters 2000 are 4¼ inches and 8 inches, and there are even larger ones at a diameter of 12 inches. Each chisel portion 400 may have a length radially, illustrated at 2002, of, for example, about ¾ inch (for all the standard size rollers, but perhaps may be a little longer for larger rollers) and ends in a blade tip 2004. I have determined that there is a range of tip-to-tip distance 2006 between which I have experienced or am confident based on the herein analysis that the roller 410 (no matter what its diameter 2000 between the normal diameter range of 4¼ to 12 inches) is most effective.

For example, for a roller diameter 2000 of 6¼ inches, 4 blades 412 equally spaced circumferentially is calculated to have a tip-to-tip distance 2006 of 4.9 inches, which is considered to be too large for maximum effectiveness, i.e., a previous blade may disengage before the next one engages, resulting undesirably in slippage. On the other hand, for the same roller diameter 2000, 8 blades 412 equally spaced circumferentially is calculated to have a tip-to-tip distance 2006 of about 2.45 inches, which is considered to be too small for maximum effectiveness, i.e., undesirably limiting the biting ability of the blades. However, for the same roller diameter 2000, 6 blades 412 equally spaced circumferentially, as shown in FIG. 14, is calculated to have a tip-to-tip distance 2006 of 3.27 inches, which is considered to be just right for maximum effectiveness, i.e., each blade efficiently and effectively bites the wood just prior to the previous blade being withdrawn. Rollers of the same diameter with 5 or 7 blades, having tip-to-tip distances of about 3.9 and about 2.8 inches respectively are also considered acceptable. For all of the above standard roller diameters, if the tip-to-tip distance 2006 is less than about 2½ inches, it is believed that the effectiveness will drop off, i.e., the biting ability of the blades being undesirably limited too much. On the other hand, if, for these standard roller diameters, the tip-to-tip distance 2006 is greater than about 4 inches, it is believed that the effectiveness will also drop off, i.e., a previous blade may disengage before the next one engages, resulting undesirably in slippage. Thus, a tip-to-tip range between about 2½ inches and about 4 inches is preferred for maximum effectiveness.

Rollers of other normal sizes (between the normal diameters of 4¼ inches and 12 inches) also are found or believed to provide maximum effectiveness within the tip-to-tip range of about 2½ to about 4 inches. It is important to recognize that the larger the roller diameter 2000, the longer the tip-to-tip distance 2006 can be for maximum effectiveness. This is because the smaller the roller diameter 2000, the more severe is each knife travel or path that causes each knife to be engaged in the wood for less time that a larger roller's knives would be. Thus, a smaller tip-to-tip distance 2006 (within the range) may be more suitable for smaller rollers while a larger tip-to-tip distance 2006 (within the range) may be more suitable for larger rollers.

For example, a roller having a diameter of 4¼ inches could have either 4 or 5 knife edges with the tip-to-tip distances being within the desired range. If this roller had only 3 knife edges, the tip-to-tip distance would be higher than within the range, resulting in the roller unduly "bouncing" across the wood as it rotates and therefore be less effective. Conversely, if this roller had as many as 6 knife edges, the tip-to-tip distance would be lower than within the range, resulting in reduced bite and therefore less effectiveness. The preferred number of knife edges would be 5 (higher than the medium, with tip-to-tip distance closer to the low end of the range). A 6¼ inch diameter in-feed roller would desirably have as few as 5 and as many as 7 knife edges (4 would be too few and 8 would be too many) and fall within the range, with the preferred number of knife blades being 6 (at the medium). An 8 inch diameter in-feed roller would desirably have as few as 7 and as many as 10 knife edges and fall within the range, with the preferred number of knife blades being 7 or 8 (lower than the medium, with tip-to-tip distance closer to the high end of the range). A 12 inch diameter in-feed roller would desirably have as few as 10 and as many as 15 knife edges and fall within the range, with the preferred number of knife blades being 10 to 12 (lower than the medium, with tip-to-tip distance closer to the high end of the range).

The prior art 6¼ inches diameter rollers 12 and 14 (FIG. 6) undesirably each have 11 chisel blades 16, resulting in a tip-to-tip distance 2006 of about 1.8 inches, which is clearly outside the range, wherein the biting ability of the blades is severely limited.

Accordingly, for any size roller 410 (within the standard roller diameters of 4¼ to 12 inches), in accordance with the present invention, the range of maximum effectiveness of the tip-to-tip distance 2006 is between about 2½ and about 4 inches. Thus, in order to fall within that range for a roller diameter 2000 of 6¼ inches, the roller 410 must have 5 to 7 chisel portions 400, preferably 6 chisel portions as shown in FIG. 14. In order to fall into that range for a roller diameter 2000 of 4¼ inches, the roller 410 must have 4 or 5 chisel portions 400. In order to fall into that range for a roller diameter 2000 of 8 inches, the roller 410 must have 7 to 10 chisel portions 400. In order to fall into that range for a roller diameter 2000 of 12 inches, the roller 410 must have 10 to 15 chisel portions 400. The particular number of chisel portions 400 for a roller of a particular diameter is selected, in accordance with the present invention, to be a number of chisel portions 400 which provide a tip-to-tip distance 2006 which is within that range of about 2½ to about 4 inches, for example, 6 chisel portions 400 for a roller having a diameter 2000 of 6¼ inches, as seen in FIG. 14.

It should be understood that, while a motor 76 can optionally (but not necessarily required) be provided for the lower smooth roller 72 so that it is driven, the lower smooth roller 72 may be assembled into the chipper without a motor so that it is an idle roller, with advantageously reduced manufacturing cost.

5. Alignment of Power Transfer from Tractor to Wood Chipper

Figure 4:
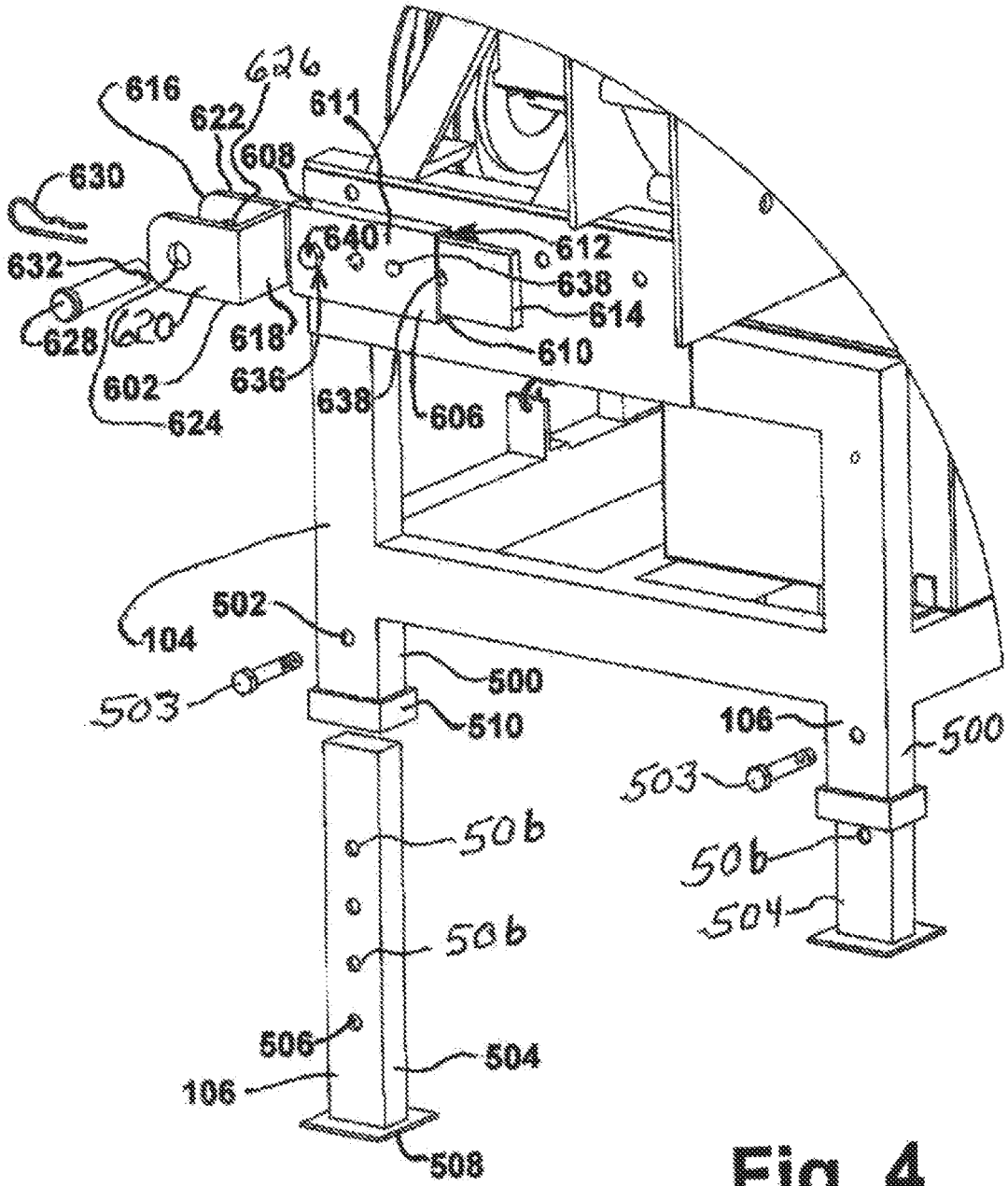
FIG. 4 is a view similar to that of FIG. 2, illustrating legs and a portion of the hitching mechanism for the wood chipper.

Different size tractors may have their splined power take-offs at different heights. While the angle between the splined power take-off member of the tractor and the power receiving protrusion 22 (FIG. 3) of the wood chipper 30 may allow their connection and operation up to about 15 degrees, an extreme angle there between may undesirably result in oscillation vibrations. Even at smaller angles there between, there may be some oscillation vibrations. Referring to FIGS. 1, 3, 4, in order to adjust the wood chipper height so that the power take-off member and the wood chipper power receiving protrusion are substantially aligned (or substantially at the same height or are as parallel as possible) thereby allowing the use of the wood chipper 30 with tractors of different sizes while eliminating or reducing such oscillation vibrations, in accordance with the present invention, the wood chipper legs 106 are height adjustable. Each leg 106 is rectangular in cross-section (could be square or otherwise) and comprises an upper vertical hollow leg portion 500 integral with (or otherwise welded or suitably attached to) the support structure 104 and with a pair of aligned apertures, one illustrated at 502, through opposite walls respectively in the upper portion thereof. Each leg 106 also comprises a lower vertical hollow leg portion 504 with a plurality of vertically spaced pairs of aligned threaded apertures, illustrated at 506, and a plate 508 suitably attached to its lower end to serve as a foot. The leg to the left in FIG. 4 is illustrated broken apart (or prior to assembly) for ease of illustration of adjustability of the legs. The lower leg portion 504 may alternatively be hollow and have vertically spaced threaded apertures extending therethrough. The lower portion of the upper leg portion 500 is received in and suitably attached to a reinforcing collar 510 (FIG. 4) for supporting the upper leg portion 500 from splitting or deforming under lateral stresses exerted from the lower leg portion 504. In order to adjust the leg height and thus the height of the wood chipper protrusion 22, the lower leg portion 504 is slidably or telescopingly received within the hollow upper leg portion 500 to the desired leg height, then a bolt 503 is received in the apertures 502 and in the pair of apertures 506 corresponding to the desired height and secured with a nut (not shown). Alternatively, if the lower leg portion 504 is solid and has threaded apertures instead of the apertures 506, then the fastener 503 is a screw which is received in one of the apertures 502, threadedly received in the selected aperture in the lower leg portion, and received in the other of the apertures 502. For example, there may be 4 location holes 506 in the lower leg portion 504 which are spaced vertically in 2-inch increments, allowing 6 inches of adjustability from the top to the bottom location hole 506.

Each of the base legs 106 may be provided with a foot pad, as seen in FIG. 1. If desired, each pair of feet or bottoms of the legs 106 (right pair and left pair) may be provided with a skid (not shown) comprising an elongate planar member of, for example, ¼ inch thick laser cut steel, suitably attached to the respective pair of feet, with each end bent upwardly at a suitable angle of, for example, about 45 degrees, to provide increased stability and strengthening of the supporting legs as well as to prevent bogging down of the chipper in mud and the like. For example, each skid may have a length of about 25 inches and a width of about 4 inches, and the bent portion at each end may have a length of about 4 inches.

6. Hitch Adjustment

Referring to FIGS. 1, 3, and 4, in order to provide easy hitching to a 3-point tractor hitch, in accordance with the present application, a series, illustrated at 600, of first, second, and third hitches 601, 602, and 603 are suitably attached to a vertical member of the support structure 104 (for hitches 601 and 602, which are substantially identical) and to a generally triangular (in plan view) bracket 604 extending horizontally rearwardly from the cutting chamber back wall 36B and tapering to the hitch 603 welded or adjustably (discussed hereinafter) or otherwise suitably attached thereto. Hitches 601 and 602 are to the left and right respectively and at about the same height as that of the splined protrusion 22, and hitch 603 is substantially vertically above the flywheel pulley 108, the series 600 of hitches thereby providing a 3-point hitch including a horizontally central upper hitch 603 and lower hitches 601 and 602 to the left and right respectively. All three hitches are suitably positioned so that all three points of hitching may be placed in a common vertical plane, as apparent in FIG. 1.

Referring to FIG. 4, an enclosure bracket 611 comprises a rectangular plate 606 having upper and lower side flanges 608 and 610 respectively welded to the support structure 104 to define an horizontally extending channel, illustrated at 612. A longer rectangular plate 614 is slidingly but snugly or securely received, with minimal play, in the channel 612 and is shown in FIG. 4 to have one end portion protruding from the rear of the channel 612. The other end thereof is welded or otherwise suitably attached to a yoke 616 which comprises a central generally square plate 618 welded at opposite edges to a pair of substantially rectangular plates 620 and 622. The plate 614 is welded or otherwise suitably attached to the yoke 616 at the junction of the plates 618 and 622 so that it is in alignment with plate 622 with plate 618 extending horizontally away from the support structure 104. Adjacent the outer edges of the plates 620 and 622 are aligned holes 624 and 626 respectively (both shown in FIG. 3 for similar hitch 601) for receiving a pin 628, which is secured by a cotter pin 630 or the like received in an aperture, illustrated at 632, of the end portion of the pin 628 after it has been received in the apertures 624 and 626 (the pins 628 and 630 not shown in FIG. 3 for hitch 601, which, as previously stated is similar to hitch 602 and therefore not further discussed herein in detail). The hitch 603 is similarly constructed to have a member which is slidable into and out of a channel (similar to channel 612) suitably formed in the bracket 604. A yoke 634, similar to yokes 616 and similarly utilizing a pin 628 and cotter pin 630 but extending downwardly at about a 45-degree angle as well as rearwardly from this member 604, so that it is also locatable in the common vertical plane with the other yokes 616. This series 600 of hitches is provided to make attachment by a standard 3-point tractor hitch easy, i.e., one need only back in with the tractor so that the hitches of the tractor are in place in the respective yokes 616, and then merely insert the pins 628 and secure with the cotter pins or by use of other suitable fastening devices (with no need to force the draw arms of the tractor around draw pins, as required with conventional implements).

The location rearwardly and thus the common vertical plane in which all of the yokes 616 are to be contained may need to be adjusted because various sizes and manufacturers of tractors have differing hitch geometries. Adjustability allows varied hitch geometries to lift the chipper in a straight up vertical fashion. In order to provide such adjustability, in accordance with the present invention, the enclosure bracket 606 has an aperture, not shown but located at 636, adjacent its rear end, and a corresponding aperture (not shown) aligned therewith is in the support structure 104. A series of apertures, illustrated at 638 (two hidden by enclosure bracket 606 and thus illustrated in dashed lines), are longitudinally spaced along the length of the slidable plate 614 and alternately alignable with the pair of aligned apertures 636 as the plate 614 is slid into and out of the channel 612. There may be, for example, 4 such horizontally spaced apertures 638 providing 4 choices of location forwardly and rearwardly for the respective hitch. When the yoke 616 is adjusted to the desired position with one of the apertures 638 aligned with aperture 636 by sliding of plate 614 forwardly or rearwardly, a bolt or other suitable fastener 640 is inserted in the apertures 636 and in the aperture 638 so aligned therewith and secured with a suitable nut (not shown) to secure the position of the yoke 616 to the desired position forwardly and rearwardly. Alternatively, the fastener 640 may be a pin secured with a cotter or spring pin or otherwise as suitable. The yoke 603 as well as yoke 601 may be similarly adjustable. It should be understood that the yokes 601, 602, and 603 may be similarly or in various other ways adjustable using principles commonly known to those of ordinary skill to those of ordinary skill in the art to which the present invention pertains, and such other ways of adjustment are meant to come within the scope of the claims. Thus, for example, yoke 603 (FIG. 1) is slidable in and out relative to its associated triangular shaped support structure 604 and suitably secured at various points there along in accordance with principles commonly known to those of ordinary skill in the art to which the present invention pertains.

7. Safety Disengage Bar Attachment to Hydraulic Controls

Referring to FIGS. 1, 11, 12, and 13, the hydraulic in-feed controller, illustrated at 85, preferably utilize three positions, i.e., forward, neutral, and reverse, and is set up in a manner using principles commonly known to those of ordinary skill in the art to which the present invention pertains, as follows. The hydraulic controller 85 for achieving such positions is conventional and therefore is not further discussed herein. For normal operation, the bar or lever 84 is positioned rearwardly or outwardly, as seen in FIG. 1, in a manner to be easily accessible to a person and easily pushed forward if an entrapped person is pulled toward the hopper. The safety disengage bar or lever 84 is suitably attached to the hydraulic controls 85 to position the hydraulic controls 85 from forward to neutral when moved inward or forward, as illustrated at 87 in FIG. 11. Pushing the bar 84 even further inward or forward 87 beyond neutral reverses the directions (opposite to the directions illustrated at 865) of rotation of the feed rollers 70 and 72. Thus, the safety bar 84 pushed inwardly or forwardly from the position of normal operation disengages the hydraulic feed rollers to neutral and further movement inwardly or forwardly thereof reverses direction thereof, these actions being via suitable linkage connected or indexed to the hydraulic control lever 84 as discussed hereinafter.

Figure 11:
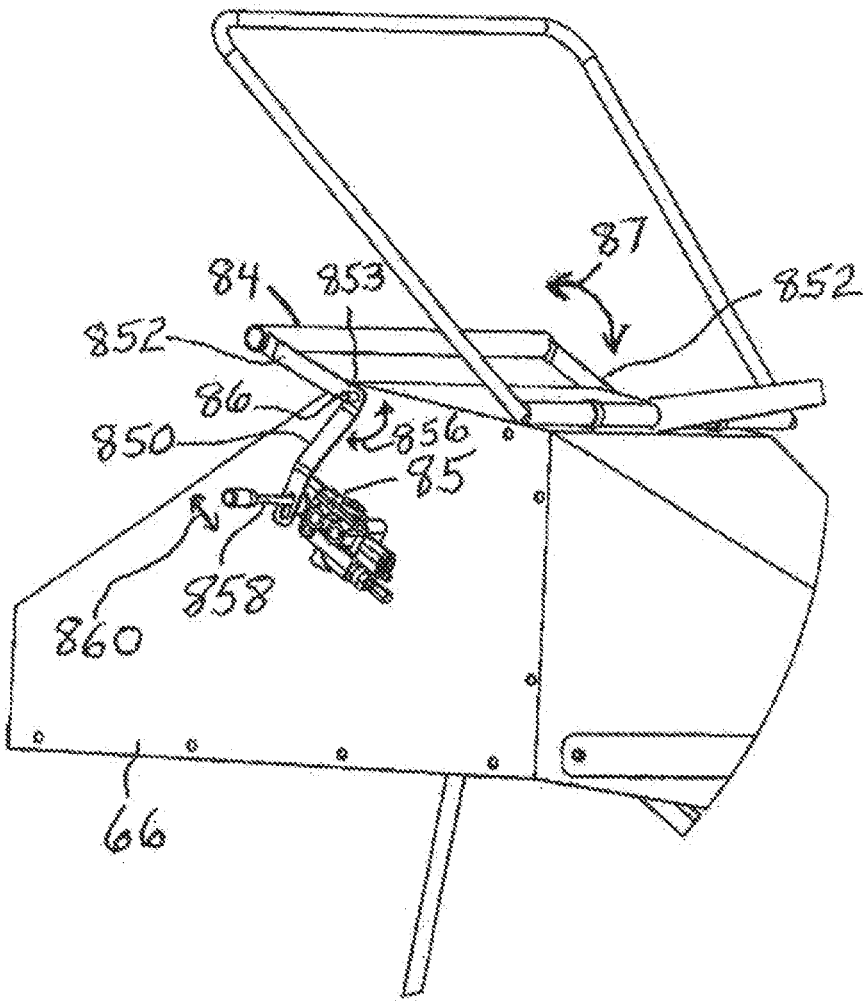
FIG. 11 is an enlarged perspective view illustrating a safety disengage bar Attachment to hydraulic controls.

As illustrated in FIGS. 1 and 11, one embodiment of the means of attachment of the safety bar 84 to the controller 85 includes arms 852 having their ends 853 pivotally attached, as illustrated at 86, to both sides of the in-feed bin 66 to achieve the bar movement in the direction 87 as well as movement in the opposite direction. A link 850 is rigidly attached at right angles to one of the arms 852 at its end 853 (i.e., at their point of attachment) so that the link 850 is pivotal, as illustrated at 856, to thereby move hydraulic control lever 858 in directions as illustrated at 860 as the bar 84 is rotated up or down about the pivots 86 to position the hydraulic controls 85 in a manner as previously discussed.

Figure 12:
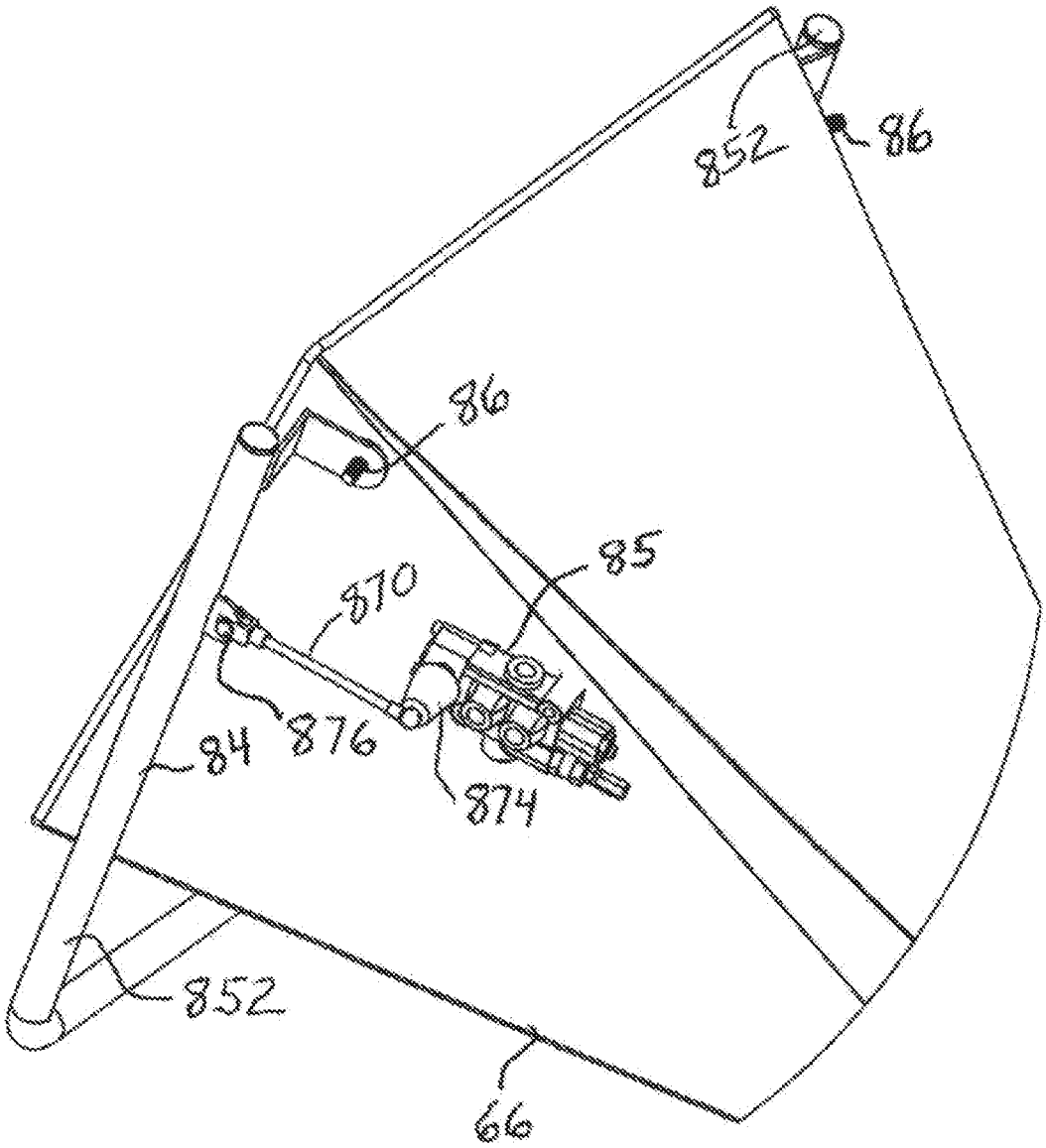
FIG. 12 is a view similar to that of FIG. 11 illustrating an alternative attachment.
Figure 13:
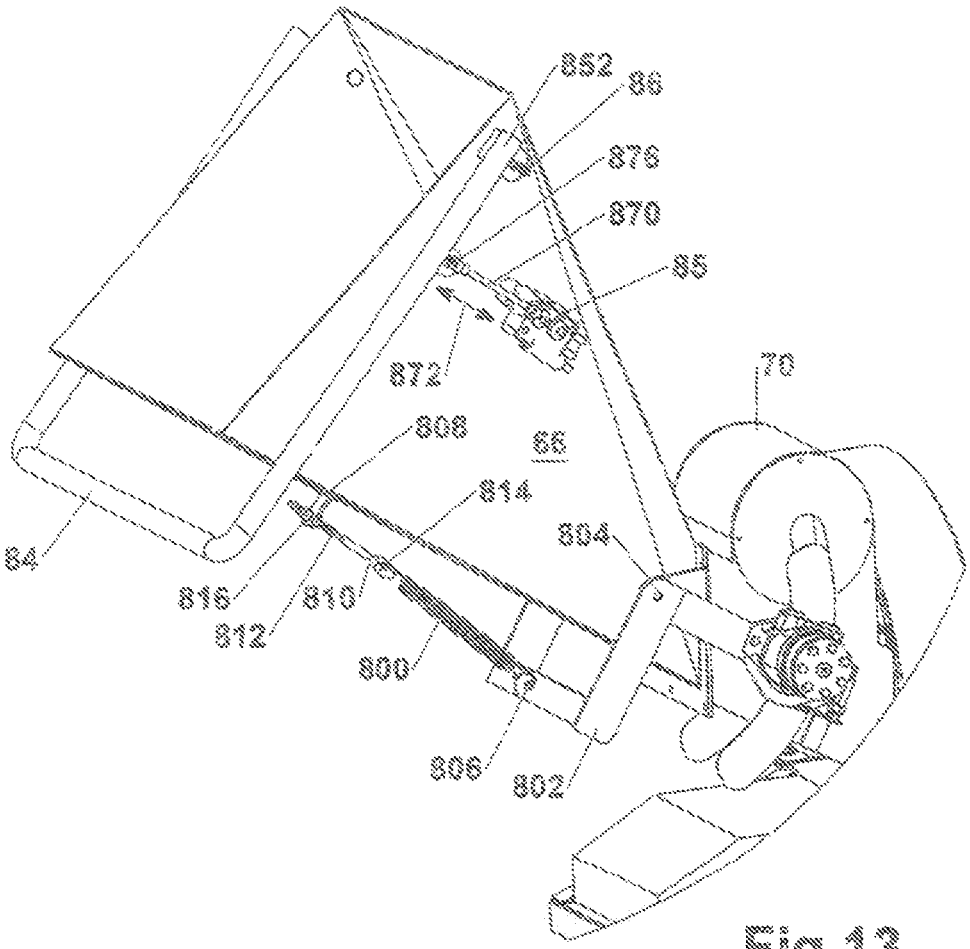
FIG. 13 is a view similar to that of FIG. 2 showing an alternative embodiment of means for applying pressure to the upper in-feed roller (i.e., the springs 300 shown in FIG. 2).

An alternative embodiment of the means of attachment of the safety bar 84 is illustrated in FIGS. 12 and 13 wherein the safety bar 84 is attached to the in-feed bin 66 similarly as discussed with respect to FIGS. 1 and 11. In this embodiment, a link 870 is pivotally attached, as at 876, at one end to a safety bar arm 852 suitably intermediate the ends thereof to effect in and out movement, as illustrated at 872, as the safety bar 84 is pivoted about pivots 86. The in and out movement 872 toggles an hydraulic control lever 874 to which the other end of the link 870 is attached to effect the desired positions of the hydraulic controls 85 in a manner as previously discussed.

8. In-feed Roller Tension Spring

In order to maintain a desired tension on the in-feed rollers, conventionally one form of the means for applying pressure to the upper in-feed roller has comprised a pair of springs (not shown in the drawings) which have been provided for the ends of a roller respectively and to extend under both sides of the hopper 66. Such pair of springs attached to independent brackets respectively require balanced spring pressures and are also subject to racking from uneven material thicknesses from end to end of the rollers. The dual springs can also create undue component wear.

Referring to FIG. 13, the dual springs of the prior art are replaced with a single spring, illustrated at 800. A single in-feed roller bracket 802 having pivot at 804 (instead of two separate brackets for the roller ends respectively, as provided in the prior art for the dual springs respectively) extends across the bottom of the hopper for connection of one end of the single spring 800 thereto at aperture 806 to provide balanced spring pressures without the need for any other mechanism for providing such balanced spring pressures, reduce or eliminate racking from uneven material thicknesses end to end, to provide a decreased cost of manufacture. In addition, the single spring 800 is located centrally under the hopper, as seen in FIG. 13, instead of the two prior art springs being located on both sides of the in-feed housing 66, wherein the single spring 800 has fewer propensities for entanglement from materials during operation. The other end of the spring 800 is connected to a bracket 808 on the underneath of the hopper, centrally thereof, via an adjustment screw 810. Thus, the adjustment screw has a threaded portion 812 which is threadedly received in a threaded aperture in bracket 808 which is suitably attached to the hopper. An eyelet, illustrated at 814, of the adjustment screw 810 is engaged to the other end of the spring 800. When the spring 810 has been adjusted to the desired in-feed roller pressure by manipulation of the adjustment screw 810, a nut 816 is suitably manipulated to secure the position and maintain the desired in-feed roller pressure.

9. Hydrostatic System (instead of hydraulic system) for In-Feed Drive Rollers

Figure 17:
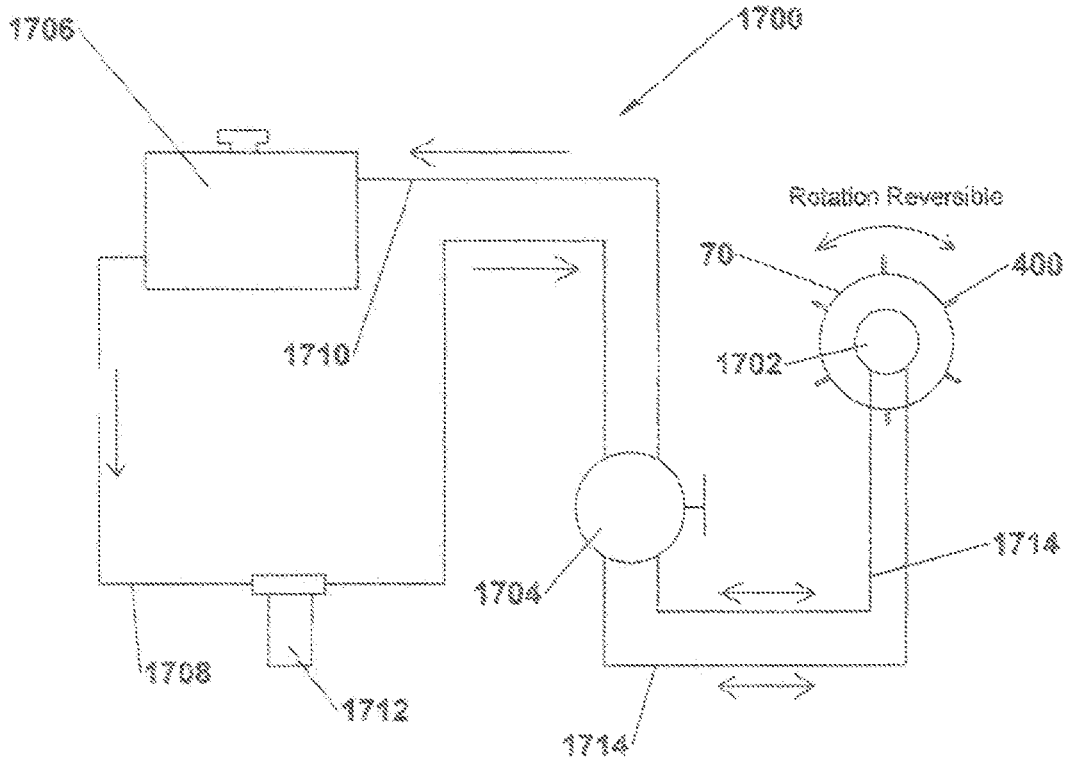
FIG. 17 is a schematic view of a hydrostatic system, instead of the hydraulic system of FIG. 16, therefor.

A conventional hydraulic system for the in-feed rollers 70 (and also 72, if driven) has a fixed in-feed rpm or one minimally or difficult to adjust, thereby preventing the operator from selecting a suitable speed on demand to match the chipper's output with various sized materials to be chipped. Referring to FIG. 17, in order to provide owners and operators with the ability to significantly increase chipping capacity by easily adjusting the in-feed roller speed therefore creating a higher output of wood chipping in less time, in accordance with the present invention, there is illustrated generally at 1700, a hydrostatic drive system.

Hydrostatic transmissions have been used, for example, as an intermediate stage between the drive shaft of an engine, such as for a lawn mower, and the wheels. Such an hydrostatic transmission is disclosed, for example, in U.S. published patent application 2011/0083413, which is hereby incorporated herein by reference. Hydrostatic drives have also been used as transmissions for automobiles and farm and construction equipment.

Within hydrostatic transmissions, hydraulic pumps are used to provide the rotational energy to the drive system, i.e., for system 1700, to an hydraulic motor, illustrated at 1702, for the in-feed roller 70. In the embodiment of FIG. 17 as well as for FIG. 18, the lower smooth in-feed roller 72 is shown to be an idler roller. However, it need not be, and this roller 72 may optionally also be a driven roller having an hydraulic motor similar to motor 1702. Hydrostatic transmissions or pumps, which utilize hydraulic pumps, receive the constant energy from the tractor power take-off or other suitable engine and provide variable output speeds. The shaft of the hydrostatic pump, illustrated at 1704, is attached to a pulley which is driven by the main shaft by use of a belt or other suitable means, similarly as the hydraulic pump 80 is attached to pulley 112 (FIG. 3) which is driven by the main shaft 108 by means of a belt 116, to which a tensioner 200 as in FIG. 3 may be similarly coupled. As the drive shaft 108 turns, the drive belt 116 turns hydro input and hydraulic fluid pumps. Even though fluid may be pumping within the hydraulic pump, pressure does not build until a swash plate is tilted. While the hydro input and hydraulic fluid pumps and swash plate are not shown in the drawings, they are well known and the principles of operation of a hydrostatic pump are well known to those of ordinary skill in the art to which the present invention pertains. The direction the swash plate is tilted by means of a forward and reverse lever, and a speed control (not shown) controls the rotational direction of the output shaft (forward and reverse) of the hydrostatic pump 1704. In addition, the amount of tilting that the swash plate experiences dictates how far the hydraulic pump pistons move which thusly determines the rotational speed applied to the hydraulic motors 1702. The greater the degree of displacement or tilt, the higher the output speed of the hydraulic motors 1702 is. Those skilled in the art appreciate that the speed of the hydraulic motors 1702 may be varied by the tilting of the swash plate thereby controlling the volume per unit time of fluid being pumped through the hydraulic motors 1702. Thus, the hydrostatic pump 1704 allows what might be called an infinite range of speed without the need for use of a control valve.

The use of the hydrostatic system 1700 in the wood chipper 30 is thus provided to achieve efficient user-friendly speed regulation and alleviation of heat build-up. This is because the hydrostatic pump design and action is much different than a typical hydraulic pump. Within the hydrostatic drive pump 1704 resides a means for regulation of the flow and pressure while the input shaft is being driven at a constant speed. A controller called the swash plate is accessed using a mechanical lever to position flow forward, reverse, and neutral. The swash plate changes the external pump output by increasing or decreasing the pumping action. The hydrostatic pump 1704 only produces the amount of flow based upon what the controller is set to. Therefore, high pressure is maintained at a reduced flow rate. Increased flow is produced as demanded or simply not produced at all. When the control lever is placed at neutral, the pump action is suspended causing a reduction of flow and pressure. This is in contrast to the conventional maximum flowing hydraulic pump illustrated at 80 (FIG. 16) with its fixed output, only to have its fluid restricted and redirected back to the reservoir 78 as the only method to regulate flow and pressure. With the hydrostatic pump 1704, there is no loss of significant pressure at reduced flow and therefore no need to divert flow and pressure to regulate speed. As a result, the system 1700 generates very little heat requiring a minimally sized fluid reservoir 1706, unlike hydraulic systems 1000 wherein much larger reservoirs 78 are usually required to dissipate heat. In essence, the efficiency is much higher for the hydrostatic system 1700 than for the typical hydraulic system 1000 for this reason.

Importantly, the hydrostatic drive system is provided to achieve a high percentage of output torque from 0% to 100% or as the industry calls it "infinite variable adjustable". For the wood chipper operator, the ability to adjust the in-feed roller speed is very desirable. It is important to be able to vary the speed as needed for the size of wood being processed at any given time. Without the ability to slow the in-feed as needed for larger wood, excessive machine wear might result or possibly the stalling of the main power source may result as the chipping knives struggle to remove material as fast as they are fed. Conversely, if an operator changes from large wood to then chipping small braches and twigs, it would be highly desirable to quickly increase the feed speed to optimize the capacity of the machine and chipping blades. The hydrostatic pump 1704 acts as a power transmission method to efficiently and quickly and easily provide the variable speed requirement to suit the requirements of the material size being chipped as determined by the operator. Unlike a hydraulic system 1000 requiring a separate flow controller 82, the hydrostatic system 1700 requires no such external plumbing and network of hoses such as by-pass circuits, case drains, or external pressure relief valves. Everything in the hydrostatic pump 1704 is contained internally within the pump body. This provides a much more efficient circuit design with neater appearance, with fewer hoses to leak or fail. Also, unlike a hydraulic circuit 1000 wherein the reservoir 78 is an integral part of the pressurized system, the hydrostatic system's reservoir 1706 is unpressurized and serves as a fluid expansion container because the majority of the hydrostatic fluid required is retained within the loop of the pump, motor, and hoses. The reservoir tank 1706 therefore can be very small reducing the fluid capacity, with the small amount of fluid cooling required providing a source for fluid filtration and fluid make-up, as required.

As a result, fewer components make up the hydrostatic transmission 1700, i.e., as shown in FIG. 17, a hydraulic fluid reservoir 1706 with supply and return lines 1708 and 1710 respectively, a hydraulic fluid filter 1712, and two-way reversible flow lines 1714 to the hydraulic motor 1702 (or motors), in addition to the hydrostatic pump 1704. Such fewer components translates advantageously to less cost for the hydrostatic system 1700 as well as less maintenance (as compared to the hydraulic system 1000 of FIG. 16).

In view of space on a wood chipper being critical, the hydrostatic transmission 1700 thus allows use of a much less capacity hydraulic fluid reservoir, i.e., for example, from 7 gallon capacity for the reservoir 78 for the hydraulic system 1000 to just 1 quart reservoir 1706 for the hydrostatic system 1700, for advantageous savings of space. In addition, the hydrostatic system 1700 is provided to advantageously have a longer life span with less maintenance, less frequent changing of hydraulic fluid, less generation of heat, and greater efficiency.

Importantly, the hydrostatic system 1700 is thus provided to achieve an increased and efficient ability to provide speed adjustment of the in-feed rollers 70 (and 72, if driven) for feeding various sized limbs, branches and other suitable materials to be chipped, i.e., to allow the operator to select a suitable speed on demand to match the chipper's output with various sized materials to be chipped, thereby to advantageously increase chipping capacity.

10. Means for Applying More Constant Tension to the Upper In-feed Roller

Although simple, the set of extension springs 300 (FIG. 2) for the in-feed roller tension device as well as the spring 800 (FIG. 13) has several drawbacks. Extension springs are exposed to the weather and may weaken over time, with corrosion exposure. Extension springs create significantly more tension the further they are extended. This causes the in-feed rollers 70 and 72 to be increasingly under higher amounts of tension as the extension springs are increasingly extended. Thus, the higher the feed roller 72 rides, for example, for a thick branch, the greater is the amount of tension which is exerted upon the fed wood material. Conversely, the smaller the wood diameter, the less tension is exerted. This weakness could possibly cause the in-feed rollers 70 and 72 to slip against the wood, undesirably slowing the chipping action.

Figure 18:
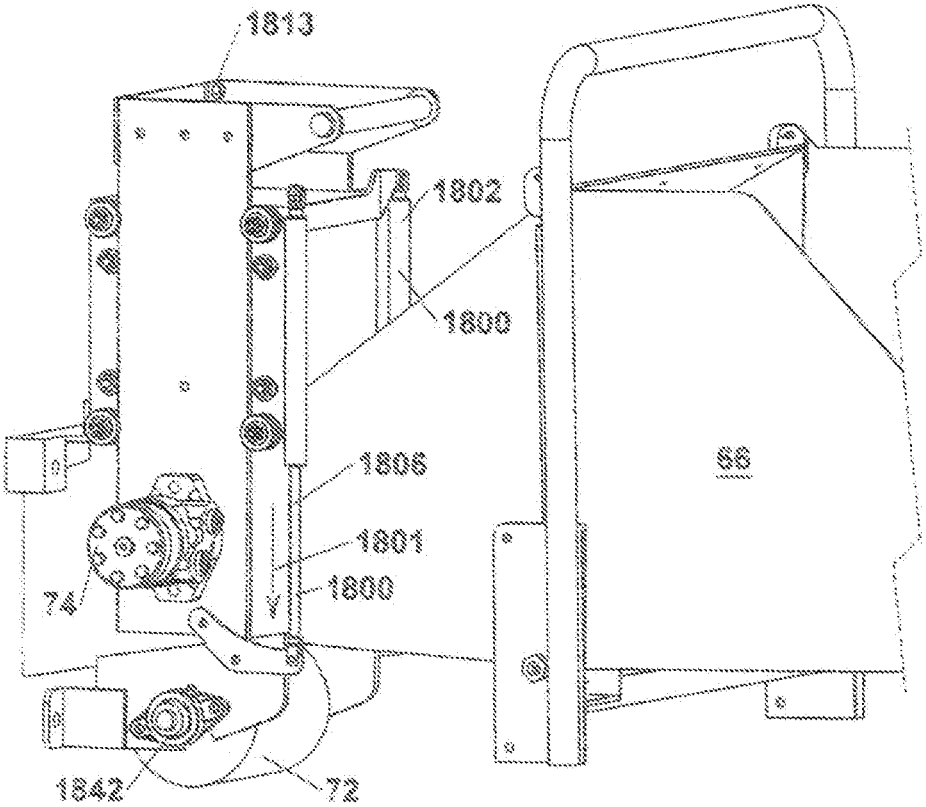
FIG. 18 is a view similar to those of FIGS. 2 and 13 showing an alternative embodiment of means for applying pressure to the upper in-feed roller (i.e., the springs 300 shown in FIG. 2 and the spring 800 shown in FIG. 13), showing gas springs extended.

Referring to FIG. 18, in order to provide more constant tension to the upper in-feed roller 70 no matter what size of wood is being processed at a given time, in accordance with the present invention, instead of the springs 300 (FIG. 2) or spring 800 (FIG. 13), a pair of compression gas springs 1800 such as pneumatic cylinders are provided to apply tension to the upper in-feed roller 70, one attached, as discussed hereinafter, to each end of the upper roller 70 (applying force to bias the upper roller 70 for movement downwardly, as illustrated at 1801). Each gas spring 1800, as is commonly known to those of ordinary skill in the art to which the present invention pertains, includes an upper housing 1802 having compressed gas therein and a gas spring rod 1806 which the compressed gas acts against to provide the desired pressure.

Gas springs are available for a variety of forces and can be sized to match each chipper size. For example, the size of each gas spring for the wood chipper 30 may be in the range of 25 to 80 pounds, more desirably 60 to 80 pounds, for example, 80 pounds each for the chipper of the present invention. Gas springs also advantageously provide a controlled rate of travel and therefore act as a shock absorber. Thus, unlike a set of tensioned extension springs, the gas springs 1800 are provided to not allow the upper in-feed roller mechanism to slam forcibly downward once the wood material passes between the rollers 70 and 72, to thereby reduce fatigue to the moving rollers 70 and 72, motor 74 or motors, and related parts. Also, the housings 1802 may advantageously afford protection to the spring 1800 from corrosive elements to thereby increase their usable life.

Figure 20:
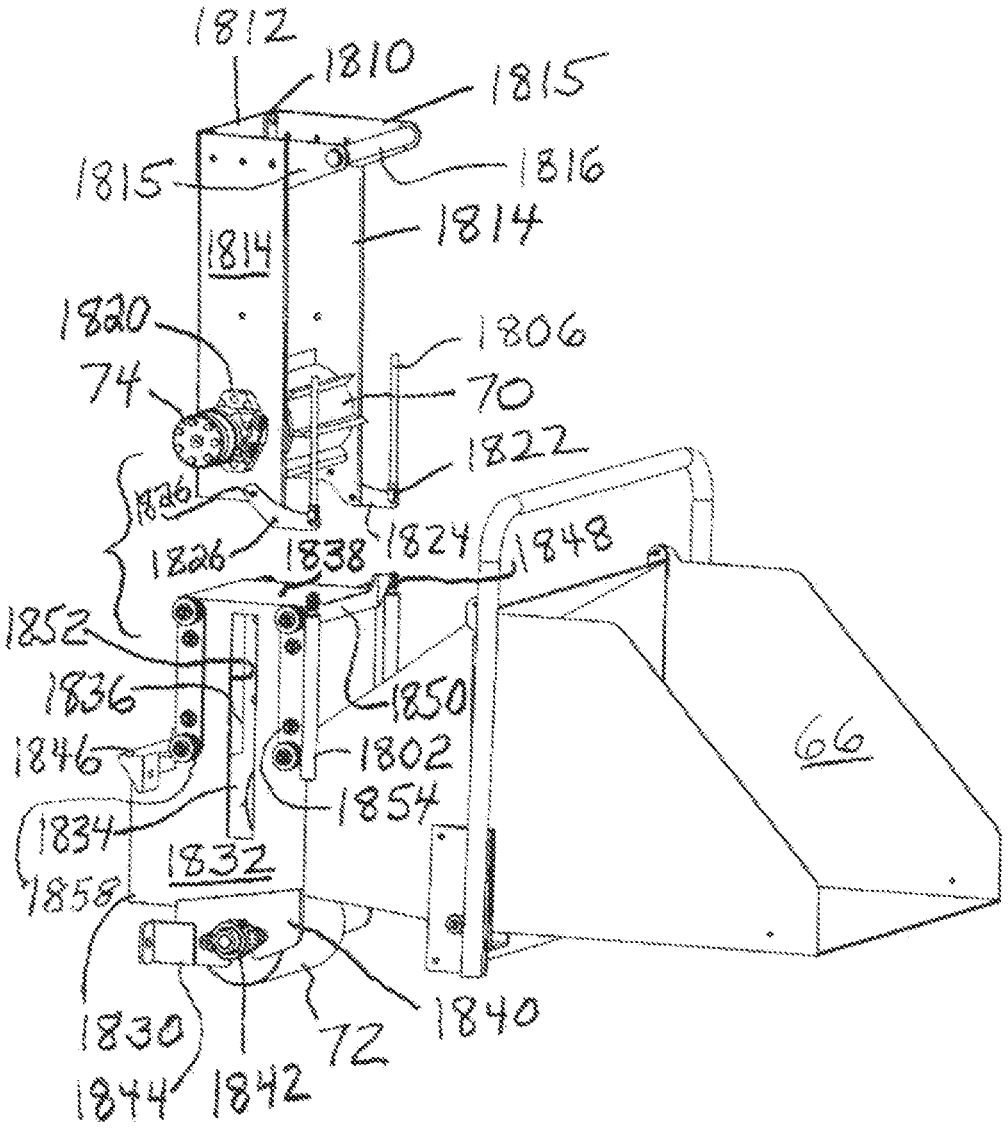
FIG. 20 is a partially exploded perspective view of the pressure applying means of FIG. 18.

Referring to FIG. 20 (in which the gas springs 1800 are shown exploded apart for convenience of illustration, but which would not normally be apart like that), the upper roller 70 is attached between a pair of vertical walls or plates 1814 of a vertically movable housing 1810, wherein the plates 1814 are bolted or otherwise suitably connected, as by fasteners 1813, by a rear upper plate 1812 so that processed wood may be fed through the space between the rear plates into the chipping chamber. A handle 1816 is suitably attached at its ends to brackets or plate extensions 1815 at the upper ends of the plates 1814 and is provided to allow the housing 1810 to be pulled upwardly for maintenance and repair and to alleviate jams. The upper roller 70 is positioned between the plates 1814 adjacent the lower end of the housing 1810, with its shaft suitably attached to the plates 1814 by a suitable integral flange bearing (one shown) and by the motor 74 (via integral attachment portion 1820) each suitably attached to the respective plate 1814 for rotation thereof. The lower ends of the gas spring rods 1806 are suitably attached as by pivots 1822 to brackets 1824 respectively which extend forwardly from the lower ends of the respective plates 1814 and are suitably fixedly attached thereto such as by fasteners at 1826.

A second housing 1830 has a pair of vertical walls or plates 1832 which are suitably fixedly attached to the hopper 66. The plates 1832 are connected by a vertical rear wall 1834 which has a suitable opening, illustrated at 1836, so that processed wood may be fed through the space between the opening 1836 into the chipping chamber. The upper ends of the plates 1832 are suitably joined by a horizontal upper wall or plate 1838. A pair of suitable brackets 1840 are suitably fixedly attached to the lower ends of the vertical plates 1832. The lower smooth roller 72 is received between the brackets 1840 and suitably attached thereto and borne by suitable flange bearings 1842 for idle rolling. At 1844 and 1846 are pairs of brackets (one each shown) by which the housing 1830 is suitably fixedly attached to the chipping chamber. The upper ends of the gas spring cylinders 1802 are suitably pivotally attached as by suitable pivots 1848 to a horizontal plate 1850 suitably fixedly attached to the upper end of the housing 1830.

Housing 1830 is suitably received within housing 1810 for vertical movement of housing 1810. The shaft for the roller 70 and motor 74 is received within a vertical slot, illustrated at 1852, in the appropriate one of the vertical plates 1832 so that the housing 1810 is vertically movable to allow for different sizes of wood passing between the rollers 70 and 72.

A pair of vertical plates 1854 (one pair shown) are suitably attached as by fasteners 1856 to each vertical plate 1832 on each side of the slot 1852 along the upper half thereof. A suitable roller 1858 is suitably rotatably attached to each of the upper and lower ends of the plates 1854 to receive the edges of the plates 1814 to allow the desired vertical movement with the edges of the plates 1814 riding between each pair of laterally spaced rollers 1858, with minimal friction upwardly and downwardly of the housing 1810. The plates 1854 are laterally adjustable for suitably receiving the plates 1814 by means of horizontally oblong holes, illustrated at 1860, for receiving the fasteners 1856.

Figure 21:
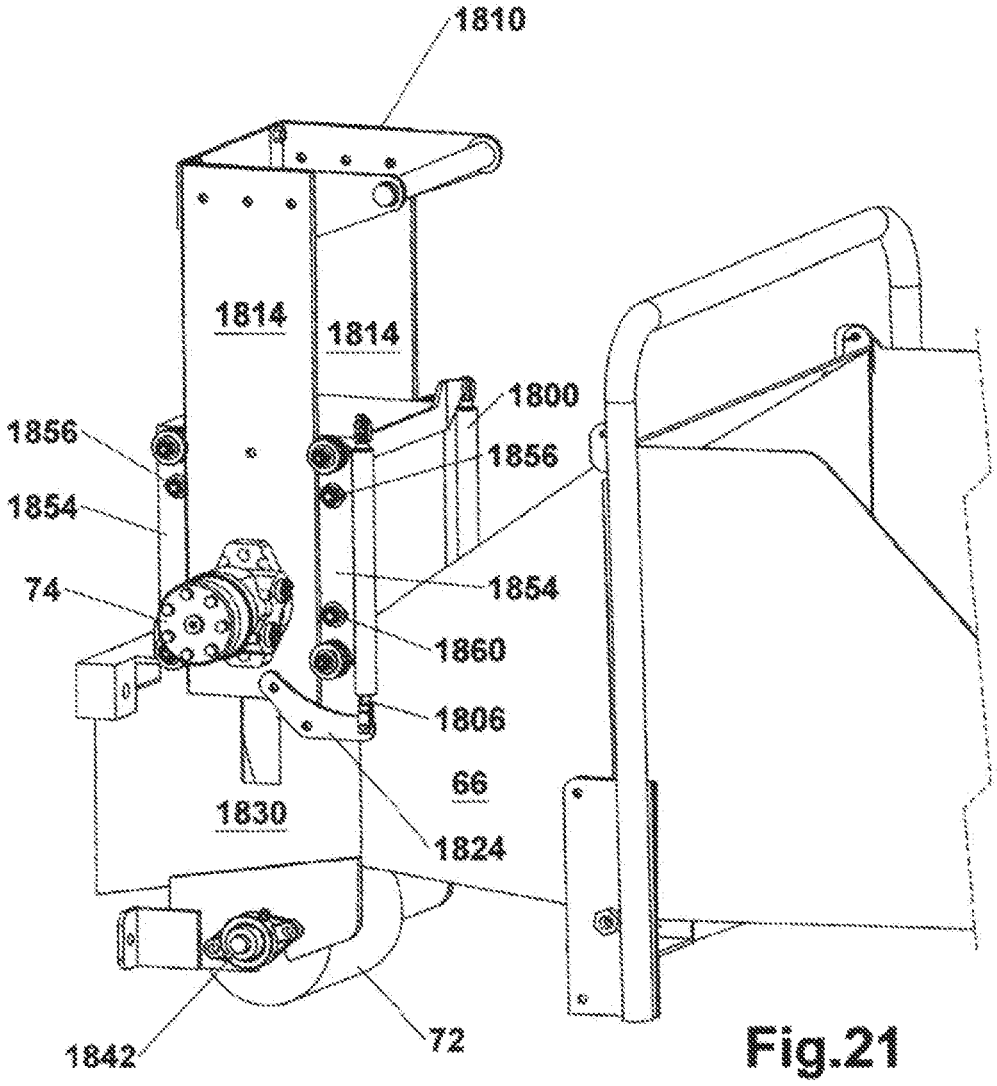
FIG. 21 is a view similar to that of FIG. 18 of the pressure applying means of FIG. 18, showing the gas springs retracted.

FIG. 18 illustrates the movable housing 1810 at the bottom of its travel, with the gas spring extended, and FIG. 21 illustrates the movable housing 1810 at the top of its travel, with the gas spring retracted, for receiving between the rollers 70 and 72 a large piece of wood, with all the while pressure 1801 being applied by the gas springs 1800 for effectively biting into the wood.

11. Knife Embodiment for Flywheel

Figure 19:
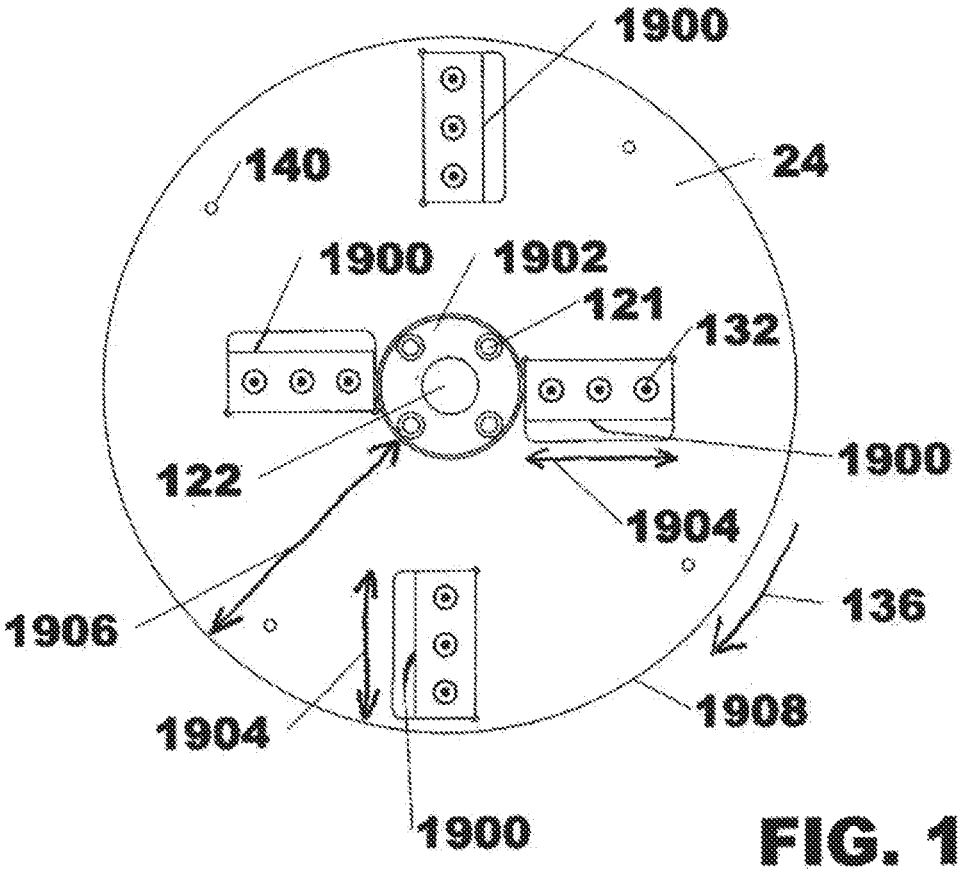
FIG. 19 is a view similar to that of FIG. 9 showing an alternative embodiment of knife blades on the face side of the flywheel.

Referring to FIG. 19, in order to provide increased inertia of a faster spinning of the flywheel 24 for the same amount of chipping, in accordance with the present invention, the flywheel (wherein the flange machined onto the shaft 122 for holes 121 is shown at 1902) contains 4 shortened knives 1900 spaced 90 degrees apart circumferentially. For example, each knife 1900 has a length, illustrated at 1904, which is substantially half of the flywheel radius, illustrated at 1906, wherein "flywheel radius" is defined, for the purposes of this specification and the claims, as the distance radially from the flange 1902 (or other shaft attachment structure at the center of the flywheel) to the outer edge of the flywheel. For example, the radius 1906 may be about 8 inches, and each knife 1900 may have a length of about 4 inches. As seen in FIG. 19, the knives 1900 are positioned circumferentially alternately adjacent the flange 1902 and the flywheel edge 1908. The knives 1900 are thusly staggered radially so that each trailing knife 1900 cuts chips from a portion of wood which is missed by the respectively leading knife 1900, i.e., adjacent knives 1900 preferably do not overlap, one extending over the inner half of the radius, and the other extending over the outer half of the radius. By "staggered" is meant that the knives 1900 are alternately positioned closer and further from the center of the flywheel 24, for example, alternately adjacent the edge of the flywheel 24 and adjacent the center thereof, as seen in FIG. 19. Thus, it can be seen that the total amount of chipping for the flywheel 24 of FIG. 19 for one revolution is the same as the total amount of chipping for the flywheel 24 of FIGS. 8 and 9 for one revolution. Advantageously, only half the power is required at the time of chipping by each of the shorter knives 1900. This allows the flywheel to "chip" at twice the normal rate, while revolving at the same speed, as the conventional two knife embodiment of FIGS. 8 and 9, while producing the same quantity of chips. This is important because some tractors and power sources are smaller and would benefit by the increased inertia of a faster spinning flywheel, without overloading or bogging down the flywheel assembly with an excessive amount of chips, which this FIG. 19 embodiment would allow. Moreover, the evening out of the power requirement over the 4 chipping operations advantageously allows a more efficient operation of the wood chipper 30.

On the other hand, the knife length 1904 may be greater than half the radius 1906 to thereby allow a slower flywheel speed, if desired or needed. It is also understood that the knife length 1904 may be less than half the radius 1906.

The arrangement of the knives 1900 in FIG. 19 constitutes one means for staggering the knives 1900 radially. Other such means which are envisioned are, but not limited to, (1) 6 spaced radially staggered knives each having a length 1904 of a third of the radius 1906, and (2) a knife having a length 1904 which is half of the radius 1906 staggered with a pair of radially aligned knives adjacent the flange 1902 and the flywheel edge respectively and each of which has a length 1904 which is a fourth of the radius 1906.

It should be understood that, while the present invention has been described in detail herein, the invention can be embodied otherwise without departing from the principles thereof, and such other embodiments are meant to come within the scope of the present invention as defined by the appended claim(s).

What is claimed is:

1. A wood chipper comprising:

a chamber which includes means therein for chipping wood and means for discharging chipped wood from said chamber;

a roller which is driven and a surface below said roller, said roller positioned for feeding of wood between said roller and said surface and into said chamber, wherein said roller has cutting elements spaced circumferentially there about;

a vertically movable housing in which said roller is rotatably received;

a stationary housing in which said surface is received;

means for effecting biting of said cutting elements into wood fed between said roller and said surface, wherein said means for effecting biting including at least one pressurized gas spring which is attached to said vertically movable housing and said stationary housing to apply a predetermined pressure to said roller to thereby cause said cutting elements of said roller to bite into wood fed between said roller and said surface, wherein said at least one pressurized gas spring includes a gas spring housing in which pressurized gas is contained and which is attached to one of said vertically movable housing and said stationary housing and further includes a rod which the compressed gas acts against to provide the predetermined pressure and which is attached to the other of said vertically movable housing and said stationary housing; and a passage through said stationary housing, wherein said passage is disposed in a manner providing a route in which wood processed by said roller is fed from said roller into said chamber, a hopper attached to said stationary housing, wherein said stationary housing is at least partially received in said vertically movable housing, wherein said at least one pressurized gas spring has an upper end portion and a lower end portion, wherein said upper end portion of said pressurized gas spring is attached to an upper end portion of said stationary housing, and wherein said lower end portion of said pressurized gas spring is attached to a lower end portion of said vertically movable housing; and a plurality of rollers attached to said stationary housing for receiving vertical edges, respectively, of said vertically movable housing to facilitate vertical movement of said vertically movable housing relative to said stationary housing.

2. The wood chipper according to claim 1 further comprising means for receiving power from a power take-off of a tractor for transmitting the power for operation of the wood chipper, and means for adjusting height of said means for receiving power to align said means for receiving power with power take-offs of different heights from different tractors respectively, wherein said means for adjusting height includes a plurality of legs which are height adjustable for supporting the wood chipper and for positioning said means for receiving power at different heights.

3. The wood chipper according to claim 2 wherein each of said legs includes two portions a first of which is telescopingly received in a second of said portions.

4. The wood chipper according to claim 1 wherein said cutting elements are blades each of which is un-notched in a direction radially of said upper roller and each of which extends over substantially the entire length of said upper roller.

5. The wood chipper according to claim 1 wherein said cutting elements are substantially equally spaced circumferentially about said roller and have a tip-to-tip distance between adjacent tips thereof which is between about 2½ inches and about 4 inches.

6. The wood chipper according to claim 1 wherein said means for chipping wood comprises a rotatable disc and a plurality of circumferentially spaced and radially extending knife blades on said disc, wherein said blades are staggered radially.

7. The wood chipper according to claim 1 further comprising one of an hydraulic pump and a hydrostatic pump for driving said roller, a belt for transferring power to said pump, and means for applying constant pressure to said belt.

8. The wood chipper according to claim 1 further comprising a series of three hitches positioned for hitching of the wood chipper to a three-point tractor hitch, wherein each of said three hitches comprises a yoke for receiving a respective tractor hitch.

9. The wood chipper according to claim 1 further comprising a hydrostatic pump for driving said roller.

10. The wood chipper according to claim 1 wherein said cutting elements are blades each of which is un-notched in a direction radially of said driven roller and each of which extends over substantially the entire length of said driven roller.

11. A wood chipper comprising:

a chamber which includes means therein for chipping wood and means for discharging chipped wood from said chamber;

a pair of rollers comprising an upper roller which is driven and a lower roller, said rollers positioned for feeding of wood between said rollers and into said chamber, wherein said upper roller has cutting elements spaced circumferentially there about;

a vertically movable housing in which said upper roller is rotatably received;

a stationary housing in which said lower roller is rotatably received;

means for effecting biting of said cutting elements into wood fed between said rollers, wherein said means for effecting biting includes at least one pressurized gas spring which is attached to said vertically movable housing and to said stationary housing to apply a predetermined pressure to said vertically movable housing whereby to cause said cutting elements of said upper roller to bite into wood fed between said rollers, wherein said at least one pressurized gas spring includes a gas spring housing in which pressurized gas is contained and which is attached to one of said vertically movable housing and said stationary housing and further includes a rod which the compressed gas acts against to provide the predetermined pressure and which is attached to the other of said vertically movable housing and said stationary housing; and a passage through said stationary housing, wherein said passage is disposed in a manner providing a route in which wood processed by said rollers is fed from said rollers into said chamber, a hopper attached to said stationary housing, wherein said stationary housing is at least partially received in said vertically movable housing, wherein said at least one pressurized gas spring has an upper end portion and a lower end portion, wherein said upper end portion of said pressurized gas spring is attached to an upper end portion of said stationary housing, and wherein said lower end portion of said pressurized gas spring is attached to a lower end portion of said vertically movable housing; and a plurality of rollers attached to said stationary housing for receiving vertical edges, respectively, of said vertically movable housing to facilitate vertical movement of said vertically movable housing relative to said stationary housing.

12. The wood chipper according to claim 11 wherein said cutting elements are blades each of which is un-notched in a direction radially of said driven roller and each of which extends over substantially the entire length of said driven roller.

13. The wood chipper according to claim 12 wherein said lower roller is a smooth roller.

14. The wood chipper according to claim 11 wherein said stationary housing has a first pair of side plates to which said lower roller is attached and further has at least one first connector plate connecting said first pair of side plates and in which said passage is disposed, wherein said vertically movable housing has a second pair of side plates to which said upper roller is attached and at least one second connector plate connecting said second pair of side plates.

15. The wood chipper according to claim 11 further comprising means for controlling operation of said rollers in forward for in-feeding of wood, neutral, and reverse, and a lever in addition to said controlling means for emergency moving of said rollers for effecting neutral then further moving for effecting reverse to said controlling means.

16. A wood chipper comprising:

a chamber which includes means therein for chipping wood;

means for discharging chipped wood from said chamber;

a roller which is driven;

a surface below said roller;

said roller and said surface are positioned for feeding of wood between said driven roller and said surface and into said chamber;

wherein said driven roller is movable vertically whereby a gap between said driven roller and said surface varies related to different sizes of wood being fed there between;

wherein said driven roller has cutting elements spaced circumferentially there about, and wherein said cutting elements are blades each of which is un-notched in a direction radially of said driven roller and each of which extends over substantially the entire length of said driven roller, means for adjusting minimum gap between said driven roller and said surface for different sizes of wood being fed between said driven roller and said surface, wherein said means for adjusting minimum gap comprises an elongate plate having one end thereof pivotally attached to the wood chipper and the other end thereof attached to the driven roller and further comprises a stop member applied to said elongate plate to adjustably limit pivoting movement of said elongate plate toward said surface to thereby adjust the minimum gap between said driven roller and said surface, and wherein said surface is a circumferential surface of a smooth roller.

17. The wood chipper according to claim 16 further comprising means including a single spring the tension on which is adjustable to apply a predetermined tension to said driven and smooth rollers whereby to cause said cutting elements of said driven roller to bite into wood fed between said driven and smooth rollers.

18. The wood chipper according to claim 16 further comprising a hydrostatic pump for driving said driven roller.

19. The wood chipper according to claim 16 wherein said means for adjusting the minimum gap further comprises a threaded elongate member received in a passage associated with said elongate plate, and wherein said stop member includes a nut which is adjustably applied along the length of said threaded elongate member to said elongate plate to define an adjusted minimum gap between said driven roller and said surface.

* * * * *